US009695642B2

(12) United States Patent
Hay

(10) Patent No.: US 9,695,642 B2
(45) Date of Patent: Jul. 4, 2017

(54) PROXIMITY DETECTION USING INSTRUMENTED CUTTING ELEMENTS

(71) Applicant: Halliburton Energy Services, Inc., Houston, TX (US)

(72) Inventor: Richard Thomas Hay, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/917,184

(22) PCT Filed: Nov. 12, 2013

(86) PCT No.: PCT/US2013/069657
§ 371 (c)(1),
(2) Date: Mar. 7, 2016

(87) PCT Pub. No.: WO2015/072971
PCT Pub. Date: May 21, 2015

(65) Prior Publication Data
US 2016/0194951 A1 Jul. 7, 2016

(51) Int. Cl.
*E21B 10/573* (2006.01)
*E21B 47/092* (2012.01)
(Continued)

(52) U.S. Cl.
CPC ..... *E21B 10/573* (2013.01); *E21B 44/005* (2013.01); *E21B 47/024* (2013.01);
(Continued)

(58) Field of Classification Search
CPC .... E21B 10/573; E21B 44/005; E21B 47/024; E21B 47/02216; E21B 2010/564; E21B 7/04; E21B 47/0905
See application file for complete search history.

(56) References Cited

U.S. PATENT DOCUMENTS 4,095,181 A * 6/1978 Harris ..... G01N 27/9013 324/238
5,176,053 A * 1/1993 Alvelid ..... B23B 27/145 374/141
(Continued)

FOREIGN PATENT DOCUMENTS

WO 2011/139697 11/2011
WO 2013/074788 5/2013

OTHER PUBLICATIONS

International Search Report and Written Opinion, Application No. PCT/US2013/069657; 11 pages, Aug. 12, 2014.
(Continued)

*Primary Examiner* — Blake Michener
(74) *Attorney, Agent, or Firm* — Baker Botts L.L.P.

(57) ABSTRACT

A drilling system is disclosed. The drilling system includes a drill string and a drill tool coupled to the drill string. The drill tool includes a cylindrical body. The drill tool further includes a plurality of blades on exterior portions of the cylindrical body. Additionally, the drill tool includes an instrumented cutting element on one of the plurality of blades. The instrumented cutting element includes a cutting table and a substrate coupled to the cutting table. The substrate includes a cavity. The instrumented cutting element further includes a core in the cavity and an electrical connector coupled to the substrate. The instrumented cutting element further includes a coil wire coupled to the electrical connector and surrounding portions of the core. The coil wire is configured to generate a signal in response to the instrumented cutting element being proximate to a magnetizable material.

22 Claims, 14 Drawing Sheets

(51) Int. Cl.

| | |
|---|---|
| ***E21B 44/00*** | (2006.01) |
| ***E21B 47/024*** | (2006.01) |
| ***E21B 7/04*** | (2006.01) |
| ***E21B 47/09*** | (2012.01) |
| ***E21B 47/022*** | (2012.01) |
| *E21B 10/56* | (2006.01) |

(52) U.S. Cl.
CPC .... *E21B 47/02216* (2013.01); *E21B 47/0905* (2013.01); *E21B 7/04* (2013.01); *E21B 2010/564* (2013.01)

(56) References Cited

U.S. PATENT DOCUMENTS 5,877,625 A * 3/1999 Togo ..... G01R 33/02 324/174
6,466,020 B2 * 10/2002 Kuckes ..... E21B 47/02216 175/45
6,924,641 B1 * 8/2005 Hanawa ..... B24B 37/013 324/226
6,986,297 B2 * 1/2006 Scott ..... E21B 10/567 164/132
7,052,215 B2 * 5/2006 Fukano ..... B23B 27/145 407/113
7,845,435 B2 12/2010 Zahradnik et al.
9,145,741 B2 * 9/2015 Trinh ..... E21B 10/43
9,212,546 B2 * 12/2015 Scott ..... E21B 47/00
9,394,782 B2 * 7/2016 DiGiovanni ..... E21B 47/00
9,500,070 B2 * 11/2016 DiGiovanni ..... E21B 47/01
2002/0112856 A1 * 8/2002 Van Steenwyk ..... H01F 13/00 166/255.1
2003/0014873 A1 * 1/2003 Towle ..... E21B 7/06 33/304
2005/0241856 A1 11/2005 Lassole et al.
2007/0114061 A1 * 5/2007 Hall ..... E21B 10/62 175/40
2007/0222441 A1 * 9/2007 Satoh ..... G01R 33/04 324/253
2009/0095479 A1 * 4/2009 Karanikas ..... E21B 36/04 166/303
2010/0089645 A1 * 4/2010 Trinh ..... E21B 10/00 175/50
2010/0096186 A1 * 4/2010 Ekseth ..... E21B 7/067 175/45
2010/0155146 A1 6/2010 Nguyen et al.
2010/0282511 A1 11/2010 Maranuk et al.
2011/0266055 A1 * 11/2011 DiGiovanni ..... E21B 10/08 175/50
2011/0266058 A1 11/2011 Kumar et al.
2012/0000707 A1 * 1/2012 Hall ..... E02F 3/06 175/40
2012/0024600 A1 * 2/2012 Bittar ..... E21B 47/01 175/50
2012/0103690 A1 5/2012 Patel et al.
2012/0132468 A1 * 5/2012 Scott ..... B01J 3/062 175/50
2012/0312599 A1 * 12/2012 Trinh ..... E21B 10/43 175/57
2012/0325564 A1 12/2012 Vaughn et al.
2013/0068525 A1 3/2013 Digiovanni
2013/0173164 A1 7/2013 Zhang
2013/0270890 A1 * 10/2013 Hall ..... E21C 35/18 299/79.1
2014/0111210 A1 * 4/2014 Fang ..... E21B 47/0905 324/346
2014/0198827 A1 * 7/2014 Liversage ..... G01K 7/16 374/185
2014/0224539 A1 * 8/2014 Kumar ..... E21B 10/08 175/50
2014/0266174 A1 * 9/2014 Hattersley ..... G01R 33/0213 324/243
2014/0326506 A1 * 11/2014 DiFoggio ..... G01H 15/00 175/39
2015/0008908 A1 * 1/2015 Buttle ..... G01L 5/0047 324/209
2015/0322720 A1 * 11/2015 Pelletier ..... E21B 47/01 175/41
2017/0030185 A1 * 2/2017 DiGiovanni ..... E21B 47/01

OTHER PUBLICATIONS

Office Action, Chinese Patent Application No. 2013800800903, with English Translation, 7 pages. Dec. 20, 2016.

* cited by examiner

PROXIMITY DETECTION USING INSTRUMENTED CUTTING ELEMENTS

RELATED APPLICATION

This application is a U.S. National Stage Application of International Application No. PCT/US2013/069657 filed Nov. 12, 2013, which designates the United States, and which is incorporated herein by reference in its entirety.

TECHNICAL FIELD

The present disclosure relates generally to downhole drilling tools and, more particularly, to proximity detection using instrumented cutting elements.

BACKGROUND

Various types of downhole drilling tools including, but not limited to, rotary drill bits, reamers, core bits, and other downhole tools have been used to form wellbores in associated downhole formations. Examples of such rotary drill bits include, but are not limited to, fixed cutter drill bits, drag bits, polycrystalline diamond compact (PDC) drill bits, and matrix drill bits associated with forming oil and gas wells extending through one or more downhole formations. Fixed cutter drill bits such as a PDC bit may include multiple blades that each includes multiple cutting elements.

In typical drilling applications, a drill bit may be used in directional and horizontal drilling. Often in directional and horizontal drilling, the drill bit will drill vertically to a certain kickoff location where the drill bit will begin to curve into the formation, and at a certain point, the drill bit may begin horizontal drilling. One of the purposes of directional and horizontal drilling is to increase drainage of a reservoir into the wellbore and increase production from a well.

However, during directional and horizontal drilling, there may be an increased risk of unintentionally contacting or drilling into an existing well or other downhole obstruction that runs across the path of the drill bit. It may be difficult to determine when a drill bit impacts or is about to impact an existing well or other downhole obstruction. Further, it may be difficult to minimize damage to the drill bit or the existing well casing or liner upon unintentional contact. In other situations, it may be desirable to contact or drill into an existing well, such as drilling a relief well. In this case, it may be advantageous to determine when the drill bit is making contact with the existing well.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
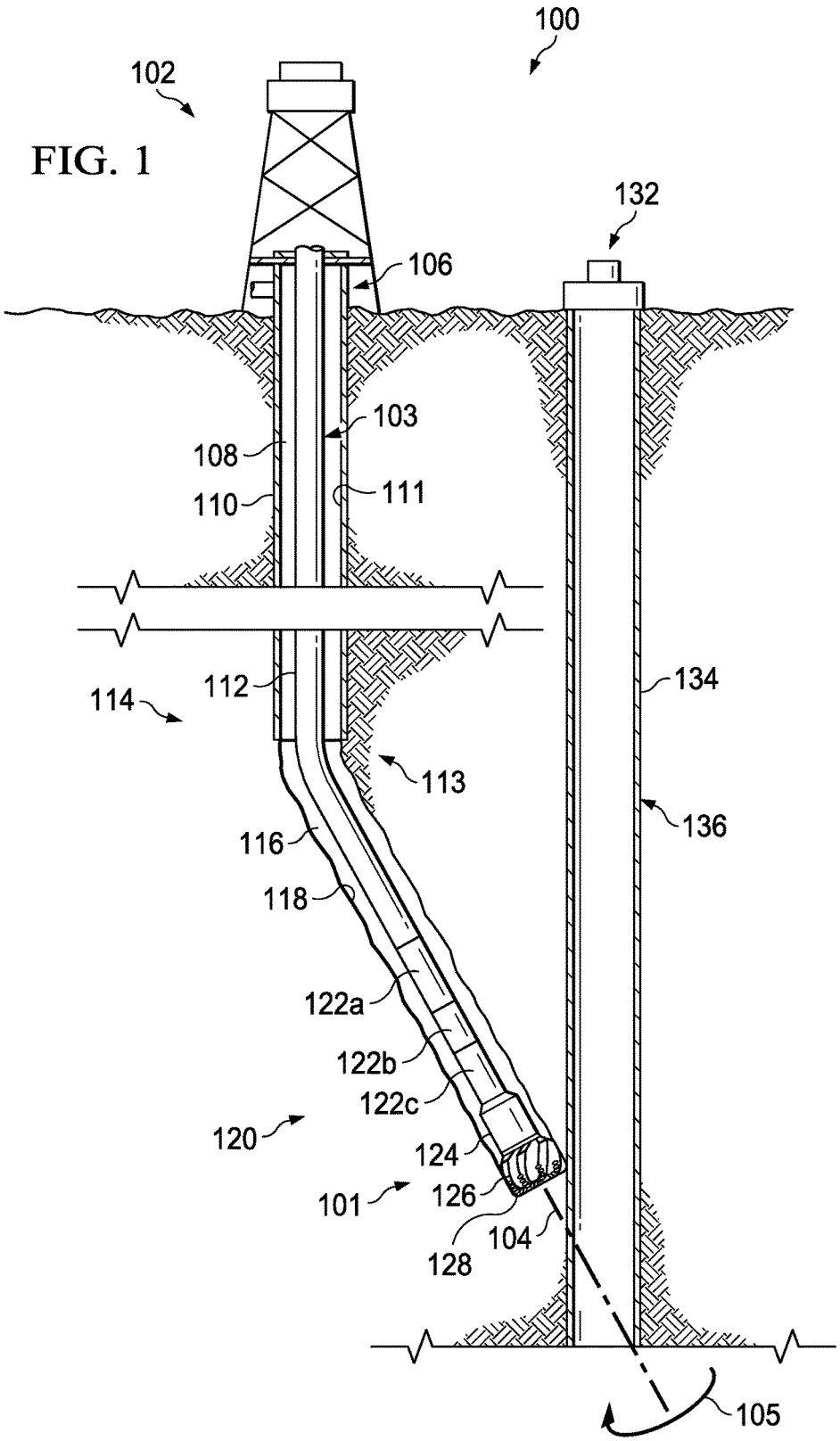
FIG. 1 illustrates an example embodiment of a drilling system configured to drill into one or more geological formations, in accordance with some embodiments of the present disclosure.

Drilling tools and associated methods are disclosed that are capable of detecting downhole obstructions while drilling, such as to detect when a downhole drilling tool contacts or is in proximity to the exterior of an existing well and/or other downhole obstacle. A disclosed drilling system may be configured to respond to the detection, such as by automatically generating an alert and/or reducing power to or decoupling the bit, to minimize damage to both the downhole drilling tool and the existing well and/or other downhole obstacle. In one example application, a driller may apply the teachings of this disclosure while drilling to avoid an intersection with an existing well, or a naturally occurring or manmade downhole obstacle. In another example application, a driller may apply the teachings of this disclosure specifically to intersect an existing well, such as in the case of drilling a relief-well. In yet another example application, the driller may apply the present teachings to follow—but not intersect—an adjacent or target well, such as to aid in the guidance of the well being drilled at a relative distance from an adjacent or target well.

As further described below, a drilling system may include a drilling tool, such as a drill bit coupled to the lower end of a drill string and having one or more instrumented cutting elements. The instrumented cutting element(s) may include various electronic components, including but not limited to proximity sensors (alternatively referred to herein as "proximity detectors" or simply "detectors"). In a particular example embodiment, an instrumented cutting element may include an internal core with a coil wire configured to generate a signal in response to the instrumented cutting element being proximate to a magnetizable material. The instrumentation may be specially configured to generate a signal responsive to when a downhole drilling tool contacts and/or is in proximity to an existing well, other downhole obstacle, and/or other manmade structure. In one practical application, for instance, the instrumented cutting element may be responsive to the metal casing of a target well, or responsive to cuttings formed when the instrumented cutting element of the drilling tool makes contact with the casing. For example, a change in magnetic flux density may be evidenced by an increase in current flowing to the coil, and thus, a change in the voltage output of coil. The current may be detected by a detection circuit located in drill bit and/or BHA. When the detection circuit detects the presence of the shavings, casing, and/or other magnetizable or manmade material, the detection circuit may transmit the data to a well site via components of the BHA and/or any other downhole telemetry system. This transmission may be used to generate an alert and or adjust power to the bit.

As further disclosed below in conjunction with the illustrated example embodiments, there may be a variety of types, positioning and packaging of proximity detectors for use in a drill bit. Proximity detectors may be located in one or more cutting elements and/or blades. In some embodiments, there may be multiple proximity detectors per cutting element to enable multidirectional sensing and/or detecting. Although discussed with reference to rotary drill bits and opening tools, detectors and other associated instrumentation may be located in and/or proximate to cutting elements mounted on any hole opening or cutting structures, such as hole openers, reamers, extendable/retractable under reamer cutting structures, tri-cone bits, casing/liner drill bits, stabilizers, and/or any other suitable downhole drilling components. Specific example embodiments of the present disclosure are further described with reference to FIGS. 1 through 13, where like reference numerals are used to indicate like and corresponding parts.

FIG. 1 is an elevation view of an example drilling system 100 configured to drill into one or more geological formations. Drilling system 100 may include a well surface, sometimes referred to as "well site" 106. Various types of drilling equipment such as a rotary table, mud pumps and mud tanks (not expressly shown) may be located at well surface or well site 106. For example, well site 106 may include drilling rig 102 that may have various characteristics and features associated with a "land drilling rig." However, downhole drilling tools incorporating teachings of the present disclosure may be satisfactorily used with drilling equipment located on offshore platforms, drill ships, semi-submersibles, and/or drilling barges (not expressly shown).

Drilling system 100 may include drill string 103 associated with drill bit 101 that may be used to form a wide variety of wellbores or bore holes such as generally vertical wellbore, generally horizontal wellbore and/or a wellbore that descends vertically and then descends at a predefined angle as shown in FIG. 1. Various directional drilling techniques and associated components of bottom hole assembly (BHA) 120 of drill string 103 may be used to form wellbore 114. For example, lateral forces may be applied to drill bit 101 proximate kickoff location 113 to form angled portions of wellbore 114 extending from generally vertical portions of wellbore 114.

BHA 120 may be formed from a wide variety of components configured to form wellbore 114. For example, components 122*a*, 122*b* and 122*c* of BHA 120 may include, but are not limited to, drill bits (e.g., drill bit 101), drill collars, rotary steering tools, directional drilling tools, downhole drilling motors, drilling parameter sensors for weight, torque, bend and bend direction measurements of the drill string and other vibration and rotational related sensors, hole enlargers such as reamers, under reamers or hole openers, stabilizers, measurement while drilling (MWD) components containing wellbore survey equipment, logging while drilling (LWD) sensors for measuring formation parameters, short-hop and long haul telemetry systems used for communication, and/or any other suitable downhole equipment. The number of components such as drill collars and different types of components 122 included in BHA 120 may depend upon anticipated downhole drilling conditions and the type of wellbore that will be formed by drill string 103 and rotary drill bit 101.

Wellbore 114 may be defined in part by casing string 110 that may extend from well site 106 to a selected downhole location. Portions of wellbore 114, as shown in FIG. 1, that do not include casing string 110 may be described as "open hole." In addition, liner sections (not expressly shown) may be present and may connect with an adjacent casing or liner section. Liner sections (not expressly shown) may not extend to the well site 106. Liner sections may be positioned proximate the bottom, or downhole, from the previous liner or casing. Liner section may extend to the end of wellbore 114. Various types of drilling fluid may be pumped from well surface 106 through drill string 103, which may contain an internal passageway for the drilling fluid to flow, to drill bit 101. Such drilling fluids may be directed to flow from drill string 103 to respective nozzles (not expressly shown) included in rotary drill bit 100. The drilling fluid may be circulated back to well surface 106 through an annulus 108 defined in part by outside diameter 112 of drill string 103 and inside diameter 118 of wellbore 114. Inside diameter 118 may be referred to as the "sidewall" or "bore wall" of wellbore 114. Annulus 108 may also be defined by outside diameter 112 of drill string 103 and inside diameter 111 of casing string 110. Open hole annulus 116 may be defined as sidewall 118 and outside diameter 112.

During the drilling of wellbore 114, drill bit 101 may drill proximate and/or come into contact with existing well 136. Existing well 136 may extend from well site 132 and may be any type of live well, e.g., operable to extract any type of material or insert any type of material or fluid, or a well that is no longer extracting any type of material. Existing well 136 may include sidewalls or casing 134 that may be composed of any type of magnetizable material, ferrous material, ferromagnetic material, transition metal material, metal alloy materials, and/or any other suitable material.

Further, during the drilling operation, drill bit 101 may drill proximate to and/or come into contact with an abandoned drill string (not expressly shown) or an active drill string (not expressly shown) in an adjacent open hole or cemented bore. Abandoned drill strings may be referred to as a "fish in the hole" and may represent a segment of a drill string, e.g., a segment that may have been lost in a wellbore due to being stuck or abandoned during a well blow out event, a partial or complete collapse of the wellbore, or a swelling constriction in the wellbore. Some or all of this abandoned drill string, or fish, may also reside within an outer casing and/or liner section.

Drilling system 100 may include rotary drill bit ("drill bit") 101. Drill bit 101 may be any of various types of fixed cutter drill bits, including PDC bits, drag bits, matrix drill bits, and/or steel body drill bits operable to form wellbore 114 extending through one or more downhole formations. Drill bit 101 may be designed and formed in accordance with teachings of the present disclosure and may have many different designs, configurations, and/or dimensions according to the particular application of drill bit 101. Drill bit 101 may be referred to generally as a "drill tool."

Drill bit 101 may include one or more blades 126 that may be disposed outwardly from exterior portions of rotary bit body 124 of drill bit 101. Rotary bit body 124 may have a generally cylindrical body and blades 126 may be any suitable type of projections extending outwardly from rotary bit body 124. Drill bit 101 may rotate with respect to bit rotational axis 104 in a direction defined by directional arrow 105.

Each of blades 126 may include a first end disposed proximate or toward bit rotational axis 104 and a second end disposed proximate or toward exterior portions of drill bit 101 (i.e., disposed generally away from bit rotational axis 104 and toward uphole portions of drill bit 101). The terms "downhole" and "uphole" may be used in this application to describe the location of various components of drilling system 100 relative to the bottom or end of a wellbore. For example, a first component described as "uphole" from a second component may be further away from the distal end of the wellbore 114 than the second component. Similarly, a first component described as being "downhole" from a second component may be located closer to the distal end of the wellbore 114 than the second component.

Figure 2A:
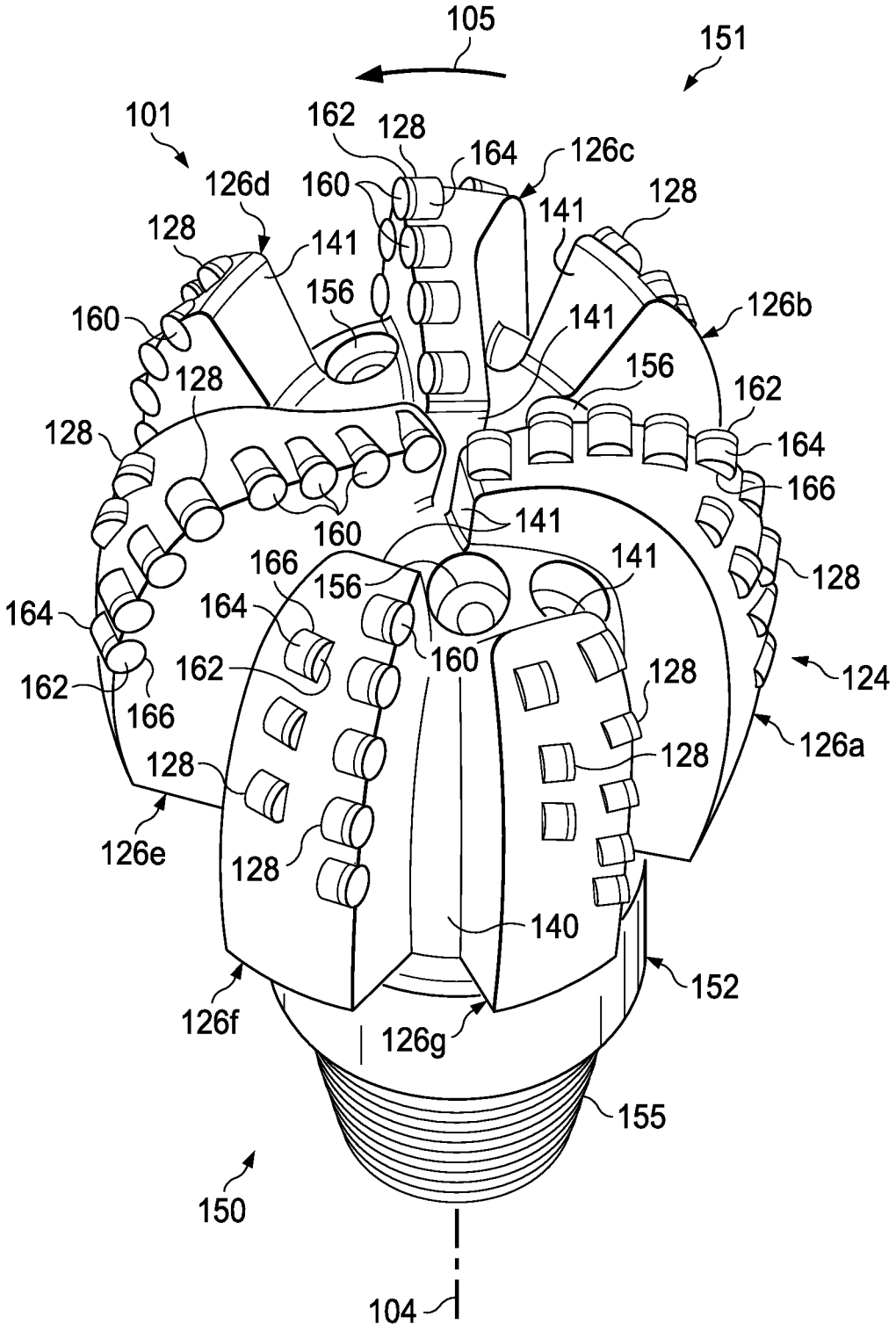
FIG. 2A illustrates an isometric view of rotary drill bit oriented upwardly in a manner often used to model or design fixed cutter drill bits, in accordance with some embodiments of the present disclosure.

As discussed in further detail in FIG. 2A, blades 126 may include one or more cutting elements 128 disposed outwardly from exterior portions of each blade 126. For example, a portion of cutting element 128 may be directly or indirectly coupled to an exterior portion of blade 126 while another portion of cutting element 128 may be projected away from the exterior portion of blade 126. Blades 126 may also include one or more depth of cut controllers (DOCCs) (not expressly shown) configured to control the depth of cut of cutting elements 128. Blades 126 may further include one or more gage pads (not expressly shown) disposed on blades 126.

FIG. 2A illustrates an isometric view of rotary drill bit 101 oriented upwardly in a manner often used to model or design fixed cutter drill bits, in accordance with some embodiments of the present disclosure. Drill bit 101 may be any of various types of fixed cutter drill bits, including PDC bits, drag bits, matrix body drill bits, steel body drill bits, and/or combination drill bits including fixed cutters and roller cone bits operable to form wellbore 114 extending through one or more downhole formations. Drill bit 101 may be designed and formed in accordance with teachings of the present disclosure and may have many different designs, configurations, and/or dimensions according to the particular application of drill bit 101.

Drill bit 101 may include one or more blades 126*a*-126*g*, collectively referred to as blades 126, that may be disposed outwardly from exterior portions of rotary bit body 124. Rotary bit body 124 may have a generally cylindrical body and blades 126 may be any suitable type of projections extending outwardly from rotary bit body 124. For example, a portion of blade 126 may be directly or indirectly coupled to an exterior portion of bit body 124, while another portion of blade 126 may be projected away from the exterior portion of bit body 124. Blades 126 formed in accordance with teachings of the present disclosure may have a wide variety of configurations including, but not limited to, substantially arched, helical, spiraling, tapered, converging, diverging, symmetrical, and/or asymmetrical.

In some cases, blades 126 may have substantially arched configurations, generally helical configurations, spiral shaped configurations, or any other configuration satisfactory for use with each downhole drilling tool. One or more blades 126 may have a substantially arched configuration extending from proximate rotational axis 104 of drill bit 101. The arched configuration may be defined in part by a generally concave, recessed shaped portion extending from proximate bit rotational axis 104. The arched configuration may also be defined in part by a generally convex, outwardly curved portion disposed between the concave, recessed portion and exterior portions of each blade which correspond generally with the outside diameter of the rotary drill bit.

Blades 126 may have a general arcuate configuration extending radially from rotational axis 104. The arcuate configurations of blades 126 may cooperate with each other to define, in part, a generally cone shaped or recessed portion disposed adjacent to and extending radially outward from the bit rotational axis. Exterior portions of blades 126, cutting elements 128 and other suitable elements may be described as forming portions of the bit face.

Blades 126*a*-126*g* may include primary blades disposed about the bit rotational axis. For example, in FIG. 2A, blades 126*a*, 126*c*, and 126*e* may be primary blades or major blades because respective first ends 141 of each of blades 126*a*, 126*c*, and 126*e* may be disposed closely adjacent to associated bit rotational axis 104. In some embodiments, blades 126*a*-126*g* may also include at least one secondary blade disposed between the primary blades. Blades 126*b*, 126*d*, 126*f*, and 126*g* shown in FIG. 2A on drill bit 101 may be secondary blades or minor blades because respective first ends 141 may be disposed on downhole end 151 a distance from associated bit rotational axis 104. The number and location of secondary blades and primary blades may vary such that drill bit 101 includes more or less secondary and primary blades. Blades 126 may be disposed symmetrically or asymmetrically with regard to each other and bit rotational axis 104 where the disposition may be based on the downhole drilling conditions of the drilling environment. In some cases, blades 126 and drill bit 101 may rotate about rotational axis 104 in a direction defined by directional arrow 105.

Each blade may have a leading (or front) surface disposed on one side of the blade in the direction of rotation of drill bit 101 and a trailing (or back) surface disposed on an opposite side of the blade away from the direction of rotation of drill bit 101. Blades 126 may be positioned along bit body 124 such that they have a spiral configuration relative to rotational axis 104. In other embodiments, blades 126 may be positioned along bit body 124 in a generally parallel configuration with respect to each other and bit rotational axis 104.

Blades 126 may include one or more cutting elements 128 disposed outwardly from exterior portions of each blade 126. For example, a portion of cutting element 128 may be directly or indirectly coupled to an exterior portion of blade 126 while another portion of cutting element 128 may be projected away from the exterior portion of blade 126. Cutting elements 128 may be any suitable device configured to cut into a formation, including but not limited to, primary cutting elements, back-up cutting elements, secondary cutting elements or any combination thereof. By way of example and not limitation, cutting elements 128 may be various types of cutters, compacts, buttons, inserts, and gage cutters satisfactory for use with a wide variety of drill bits 101.

Cutting elements 128 may include respective substrates with a layer of hard cutting material, e.g., cutting table 162, disposed on one end of each respective substrate, e.g., substrate 164. Cutting table 162 of each cutting elements 128 may provide a cutting surface that may engage adjacent portions of a downhole formation to form wellbore 114. Each substrate 164 of cutting elements 128 may have various configurations and may be formed from tungsten carbide with a binder agent such as cobalt or other materials associated with forming cutting elements for rotary drill bits. Tungsten carbides may include, but are not limited to, monotungsten carbide (WC), ditungsten carbide ($W_2C$), macrocrystalline tungsten carbide, and cemented or sintered tungsten carbide. Substrates 164 may also be formed using other hard materials, which may include various metal alloys and cements such as metal borides, metal carbides, metal oxides and metal nitrides. For some applications, cutting table 162 may be formed from substantially the same materials as substrate 164. In other applications, cutting table 162 may be formed from different materials than substrate 164. Examples of materials used to form cutting table 162 may include polycrystalline diamond materials, including synthetic polycrystalline diamonds. Blades 126 may include recesses or bit pockets 166 that may be configured to receive cutting elements 128. For example, bit pockets 166 may be concave cutouts on blades 126.

In some embodiments, blades 126 may also include one or more DOCCs (not expressly shown) configured to control the depth of cut of cutting elements 128. A DOCC may comprise an impact arrestor, a back-up cutting element and/or a modified diamond reinforcement (MDR). Exterior portions of blades 126, cutting elements 128 and DOCCs (not expressly shown) may form portions of the bit face.

Blades 126 may further include one or more gage pads (not expressly shown) disposed on blades 126. A gage pad may be a gage, gage segment, or gage portion disposed on exterior portion of blade 126. Gage pads may often contact adjacent portions of wellbore 114 formed by drill bit 101. Exterior portions of blades 126 and/or associated gage pads may be disposed at various angles, positive, negative, and/or parallel, relative to adjacent portions of generally vertical portions of wellbore 114. A gage pad may include one or more layers of hardfacing material.

Uphole end 150 of drill bit 101 may include shank 152 with drill pipe threads 155 formed thereon. Threads 155 may be used to releasably engage drill bit 101 with BHA 120, shown in FIG. 1, whereby drill bit 101 may be rotated relative to bit rotational axis 104. Downhole end 151 of drill bit 101 may include a plurality of blades 126*a*-126*g* with respective junk slots or fluid flow paths 140 disposed therebetween. Additionally, drilling fluids may be communicated to one or more nozzles 156.

In some embodiments, detectors (not expressly shown) may be placed in one or more cutting elements 128. Detectors may be configured to detect the presence of an existing well, such as existing well 134 shown in FIG. 1, and/or other downhole obstacles. As is discussed in more detail below with reference to FIGS. 7A-7C, core cap 160 may be integrated with cutting table 162 of one or more cutting elements 128.

Figure 2B:
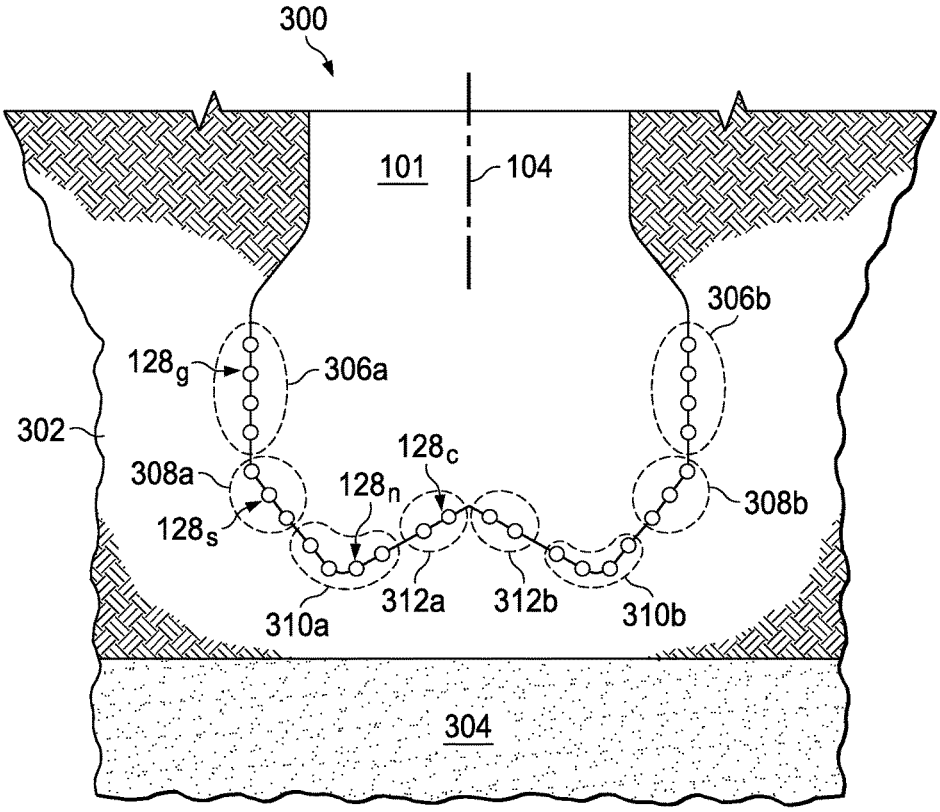
FIG. 2B illustrates a bit face profile of a drill bit configured to form a wellbore through a first formation layer into a second formation layer, in accordance with some embodiments of the present disclosure.

FIG. 2B illustrates bit face profile 300 of drill bit 101 configured to form a wellbore through first formation layer 302 into second formation layer 304, in accordance with some embodiments of the present disclosure. Exterior portions of blades (not expressly shown), cutting elements 128 and DOCCs (not expressly shown) may be projected rotationally onto a radial plane to form bit face profile 300. In the illustrated embodiment, formation layer 302 may be described as "softer" or "less hard" when compared to downhole formation layer 304.

As shown in FIG. 2B, exterior portions of drill bit 101 that contact adjacent portions of a downhole formation may be described as a "bit face." Bit face profile 300 of drill bit 101 may include various zones or segments. Bit face profile 300 may be substantially symmetric about bit rotational axis 104 due to the rotational projection of bit face profile 300, such that the zones or segments on one side of rotational axis 104 may be substantially similar to the zones or segments on the opposite side of rotational axis 104.

For example, bit face profile 300 may include gage zone 306*a* located opposite gage zone 306*b*, shoulder zone 308*a* located opposite shoulder zone 308*b*, nose zone 310*a* located opposite nose zone 310*b*, and cone zone 312*a* located opposite cone zone 312*b*. Cutting elements 128 included in each zone may be referred to as cutting elements of that zone. For example, cutting elements $\mathbf{128}_g$ included in gage zones 306 may be referred to as gage cutting elements, cutting elements $\mathbf{128}_s$ included in shoulder zones 308 may be referred to as shoulder cutting elements, cutting elements $\mathbf{128}_n$ included in nose zones 310 may be referred to as nose cutting elements, and cutting elements $\mathbf{128}_c$ included in cone zones 312 may be referred to as cone cutting elements.

Cone zones 312 may be generally concave and may be formed on exterior portions of each blade (e.g., blades 126 as illustrated in FIG. 2A) of drill bit 101, adjacent to and extending out from bit rotational axis 104. Nose zones 310 may be generally convex and may be formed on exterior portions of each blade of drill bit 101, adjacent to and extending from each cone zone 312. Shoulder zones 308 may be formed on exterior portions of each blade 126 extending from respective nose zones 310 and may terminate proximate to respective gage zone 306.

In some embodiments, detectors (not expressly shown), discussed in detail with reference to FIG. 4 below, may be located in and/or proximate to cutting elements 128 in one or more zones or segments. For example, cutting elements containing detectors may be located in shoulder zones 308*a* and 308*b*. As another example, cutting elements containing detectors may be located in shoulder zones 308*a* and 308*b*, nose zones 310*a* and 310*b*, and/or in any other appropriate zone based on implementation.

Figure 3:
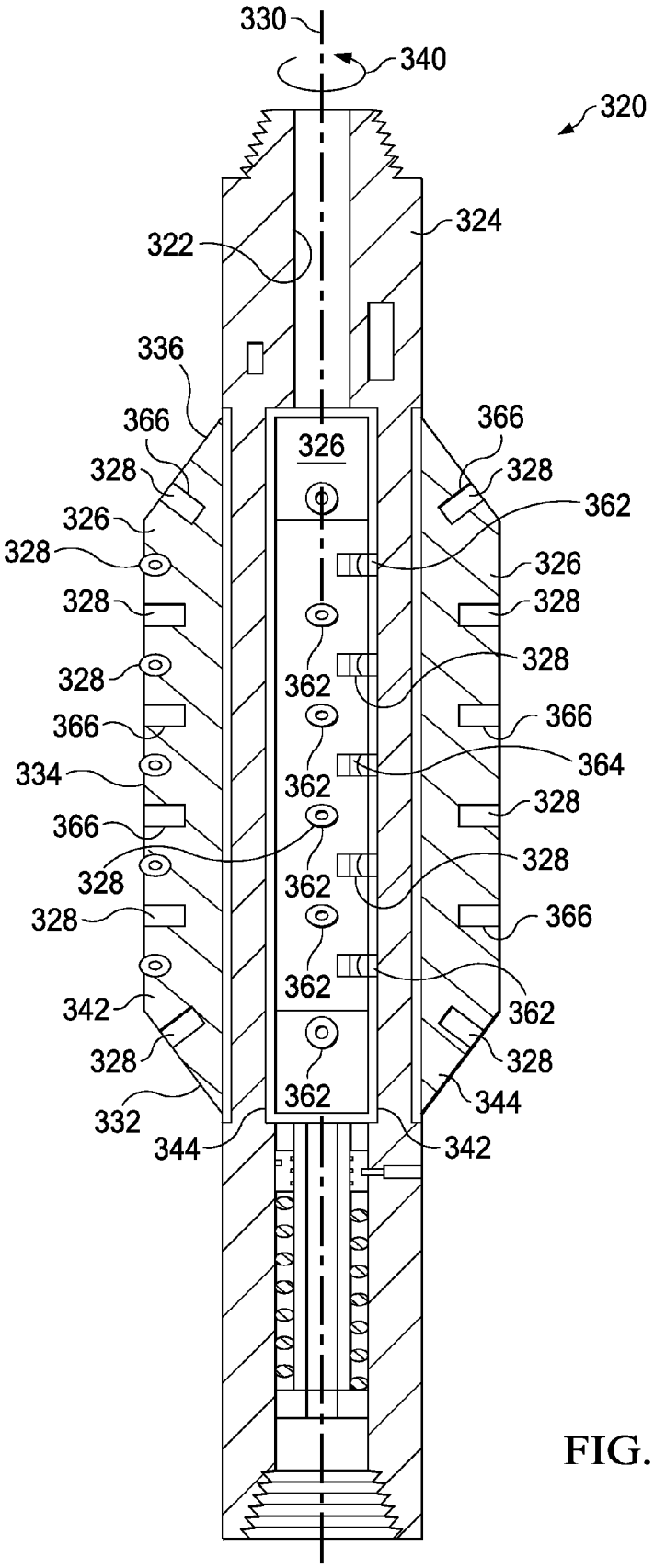
FIG. 3 illustrates an isometric view of a downhole tool, in accordance with some embodiments of the present disclosure.

FIG. 3 illustrates an isometric view of drill or hole opening tool 320, in accordance with some embodiments of the present disclosure. Tool 320 may be any type of stabilizer, reamer, underreamer and/or any other type of tool utilized to open and/or drill a wellbore. For example, a variable gage underreamer may include blades that extend radially and/or blades that remain stationary. Tool 320 may be designed and formed in accordance with teachings of the present disclosure and may have many different designs, configurations, and/or dimensions according to the particular application of tool 320.

Tool 320 includes tubular body 324 with longitudinal axial cavity 322 extending therethrough. Tubular body 324 may be mounted between two sections of a drill string (not expressly shown). Tool 320 may rotate with respect to longitudinal axis 330 in a direction defined by directional arrow 340.

Tool 320 may include one or more blades 326 that may be disposed outwardly from exterior portions of tubular body 324 of tool 320. Tubular body 324 may have a generally cylindrical body and blades 326 may be any suitable type of projections extending outwardly tubular body 324. For example, a portion of blade 326 may be directly or indirectly coupled to an exterior portion of tubular body 324, while another portion of blade 326 may be projected away from the exterior portion of tubular body 324. The number and location of blades 326 may vary such that tool 320 includes more or less blades 326 than shown. Blades 326 may be disposed symmetrically or asymmetrically with regard to each other and longitudinal axis 330 where the disposition may be based on the downhole drilling conditions of the drilling environment. Blades 326 may be positioned along tubular body 324 such that they have a spiral configuration relative to longitudinal axis 330. In other embodiments, blades 326 may be positioned along tubular body 324 in a generally parallel configuration with respect to each other and longitudinal axis 330.

Each of blades 326 may include front part 332 with a downhole end inclined toward longitudinal axis 330, central part 334 substantially parallel to axis 330, and rear part 336 with an uphole end inclined toward axis 330. Front part 332 may be intended to produce an underreaming of the drill hole during tool 320 descent. Central part 334 may be intended to stabilize tool 320 with respect to the underreamed hole. Rear part 336 may be intended to produce an underreaming of the drill hole when raising the drill string. Each blade 326 may include leading surface 342 disposed on one side of the blade in the direction of rotation of tool 320 and trailing (or back) surface 344 disposed on an opposite side of the blade away from the direction of rotation of tool 320.

Blades 326 may include one or more cutting elements 328 disposed outwardly from exterior portions of each blade 326. For example, a portion of cutting element 328 may be directly or indirectly coupled to an exterior portion of blade 326 while another portion of cutting element 328 may be projected away from the exterior portion of blade 326. Cutting elements 328 may be any suitable device configured to cut into a formation, including but not limited to, primary cutting elements, back-up cutting elements, secondary cutting elements or any combination thereof. By way of example and not limitation, cutting elements 328 may be various types of cutters, compacts, buttons, inserts, and gage cutters satisfactory for use with a wide variety of tools 320.

Cutting elements 328 may include respective substrates with a layer of hard cutting material, e.g., cutting table 362, disposed on one end of each respective substrate, e.g., substrate 364. Cutting table 362 of each cutting elements 328 may provide a cutting surface that may engage adjacent portions of a downhole formation to form wellbore 114. Each substrate 364 of cutting elements 328 may have various configurations and may be formed from tungsten carbide with a binder agent such as cobalt or other materials associated with forming cutting elements for rotary drill bits. Tungsten carbides may include, but are not limited to, monotungsten carbide (WC), ditungsten carbide ($W_2C$), macrocrystalline tungsten carbide, and cemented or sintered tungsten carbide. Substrates 364 may also be formed using other hard materials, which may include various metal alloys and cements such as metal borides, metal carbides, metal oxides and metal nitrides. For some applications, cutting table 362 may be formed from substantially the same materials as substrate 364. In other applications, cutting table 362 may be formed from different materials than substrate 364. Examples of materials used to form cutting table 362 may include polycrystalline diamond materials, including synthetic polycrystalline diamonds.

Blades 326 may include recesses or bit pockets 366 that may be configured to receive cutting elements 328. Bit pockets 366 may be concave cutouts on blades 326. Bit pockets 366 may be slanted such that cutting elements 328 brazed into bit pockets 366 may be retained in a mechanically suitable manner. Further, a wire path (not expressly shown) may exist proximate to bit pockets 366 to facilitate signals from cutting element 328. Tool 320 may include cutting elements 328 brazed into bit pockets 366 of blades 326 in any suitable direction. For example, a particular tool 320 configured as a stabilizer may include cutting elements 328 disposed on front part 332, central part 334, and/or rear part 336. As another example, a particular tool 320 configured as a variable gage underreamer may have cutting elements 328 mounted on leading surface 342 of blades 326. Blades 326 may extend out to cut into the wellbore as the underreamer is rotated.

In some embodiments, tool 320 may include central sensor electronics (not expressly shown) that may include a processor and memory for operating detectors and collecting data, as discussed in detail below with reference to FIG. 4. Tool 320 may be communicatively coupled to a BHA, such as BHA 120 shown in FIG. 1. Data collected may be passed to a long haul telemetry system via a telemetry communication interface system that permits communications with the drill string and/or BHA telemetry system. For example, a telemetry system may include a mud pulse, electromagnetic, acoustic, torsional, pipe in pipe, or wired pipe telemetry system. Further, the sensor electronics may be distributed over a the length of the BHA and/or drill string such that detectors may be separately addressable, data sample rates may be modified, and/or other suitable communications may occur.

Figure 4:
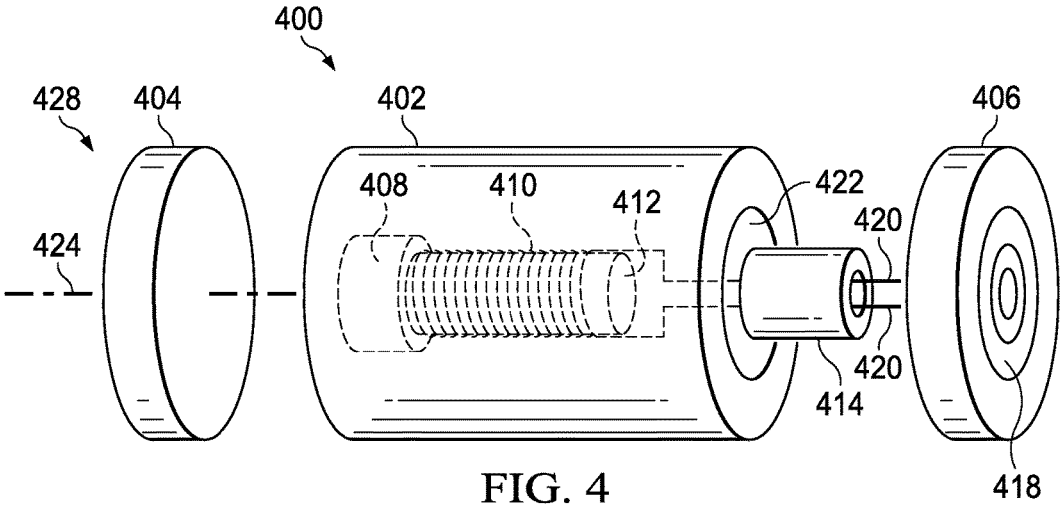
FIG. 4 illustrates an exploded view of a detector configured to be located in an instrumented cutting element, in accordance with some embodiments of the present disclosure.

FIG. 4 illustrates an exploded view of detector 400 configured to be located in instrumented cutting element 428, in accordance with some embodiments of the present disclosure. A particular cutting element that includes detector 400 may be referred to as instrumented cutting element 428. In the present embodiment, cutting table 404 (similar to cutting table 162 shown in FIG. 2A and/or cutting table 362 shown in FIG. 3) may be a PDC cutting table. Substrate 402 (similar to substrate 164 shown in FIG. 2A and/or substrate 364 shown in FIG. 3) may be composed of tungsten carbide with a cobalt binder. Substrate 402 may include cavity 422. Cavity 422 may be machined in substrate 402, created with the use of an electro discharge machine (EDM) process, and/or manufactured with any other suitable method based in part on the conductivity, hardness and/or any other property of substrate 402.

In some embodiments, permanent magnet 408 may be located in cavity 422 adjacent and/or proximate to cutting table 404. Permanent magnet 408 may be any suitable magnet capable of withstanding the brazing temperature experienced when coupling cutting table 404 to substrate 402. For example, permanent magnet 408 may be a samarium-cobalt ($SmCo_5$) magnet with a maximum operating temperature of approximately four hundred degrees Celsius. As another example, permanent magnet 408 may be an Alnico magnet (e.g., composed primarily of iron and aluminum (Al), nickel (Ni) and cobalt (Co)) with a maximum operating temperature of approximately five hundred forty degrees Celsius. Permanent magnet 408 may also include other transition metals and transition metal alloys, particularly iron-based or cobalt-based alloys. Permanent magnet 408 may include more than one type of alloy to provide a distinctive magnetic flux density. Permanent magnet 408 may further be shrouded (not expressly shown) to minimize and/or prevent direct contact with substrate 402 and/or to encourage magnetic flux source in the axial direction, e.g., along sense axis 424, out of cutting table 404. Additionally, minimization of cobalt in the manufacture of cutting table 404 through methods such as acid leaching and/or or selective leaching, may further improve magnetic flux leakage from the magnetic flux source in the axial direction out of cutting table 404.

In some embodiments, to minimize magnetic interference, it may be advantageous to minimize the magnetic permeability of other materials used in the manufacture of detector 400. Magnetic permeability may be the measure of the ability of a material to support the formation of a magnetic field within itself. In other words, magnetic permeability may be the degree of magnetization that a material obtains in response to an externally applied magnetic field. As example, cobalt, which may be used as a binder in substrate 402, may have a relative magnetic permeability, $\mu_r$, of approximately seventy. Cobalt may act as a magnetic flux short circuit (e.g., cause magnetic interference) in operation of detector 400. As a result, at least a portion of substrate 402 may optimally contain a different binder agent. Elimination of cobalt from substrate 402 proximate cutting table 404 may be challenging due to the manufacturing process for cutting table 404. For example, cobalt may wick up proximate to and/or into cutting table 404 during formation. Other materials that are weakly magnetic or non-magnetic (e.g., have a $\mu_r$ approximately equal to one) may be substituted for cobalt in formation of substrate 402. For example, other slightly magnetic binders may include tungsten alloys containing Ni—Fe binders, and/or relatively non-magnetic binders may include tungsten alloys containing Ni—Cu. These tungsten alloys may be defined in various American Society for Testing and Materials (ASTM) standards, such as ASTM B777-07, and/or Society of Automotive Engineers (SAE) Technical Standard AMS-T-21014. Tungsten alloys are exemplary only and other alloys may be utilized based on the implementation. As another example, substrate 402 may be manufactured with a non-magnetic material such as an austenitic stainless steel or Titanium.

In some embodiments, cutting table 404 may also be manufactured utilizing a low magnetic or a non-magnetic binder. Using low magnetic or non-magnetic binders may further reduce the possibility of magnetic flux short circuiting or magnetic interference during operation of detector 400. For example, a Cu—Mn—Ni—Zn alloy may be utilized as a binder for cutting table 404. The Cu—Mn—Ni—Zn alloy is a non-magnetic/low magnetic binder. Further, the Cu—Mn—Ni—Zn alloy may also be utilized as a binder in substrate 402.

Core 412 may be configured to support coil 410 and may be located proximate and/or in contact with permanent magnet 408. Core 412 may be composed of a material that may have a high magnetic permeability. For example, core 412 may be composed of magnetic transition metals and transition metal alloys, particularly annealed (soft) iron or a permalloy (sometimes referred to as a "MuMetal"), which are a family of Ni—Fe—Mo alloys, ferrite, or any other alloy that exhibits ferromagnetic properties. Core 412 may include more than one type of alloy to support a variable magnetic flux density ($Wb/m^2$) when exposed to variations in the reluctance of the magnetic circuit.

In some embodiments, portions of core 412 may be a permanent magnet and/or other portions may be a highly magnetically permeable material. In some embodiments, core 412 may be permanent magnet. As example, existing permanent magnet 408 may be extended to partially and/or fully replace core 412 to support coil 410, or alternately, a separate permanent magnet may be utilized. In either case, the orientation of the magnetic poles of permanent magnet 408 and the magnetic poles of core 412, may then be organized in a North-South-North-South axial arrangement or in the opposite order, to ensure that the magnetic flux extends through both permanent magnets with minimal flux leakage. In some embodiments, when core 412 is partially or entirely a permanent magnet, core 412 may be constructed of similar material to permanent magnet 408. In this instance, core 412 may be referred to as a magnetic flux source.

In a configuration in which core 412 is partially or entirely a permanent magnet, permanent magnet 408 may be a highly permeable material similar to the materials discussed with reference to core 412. Hence, location of the magnetic source in the magnetic circuit may be positioned anywhere in the desired magnetic flux path. A permanent magnet source may be a samarium-cobalt ($SmCo_5$) magnet, an Alnico magnet (e.g., composed primarily of iron, aluminum (Al), nickel (Ni) and cobalt (Co)), and/or any other suitable magnet. Further, in some embodiments, permanent magnet 408 and/or core 412 may be an electromagnet including a highly magnetically permeable core and a magnetizing winding (not expressly shown) to energize the magnetic circuit with a magnetic flux.

In some embodiments, detector 400 may function as a "reluctance sensor." During operation, when cutting table 404 of instrumented cutting element 428 approaches an external magnetizable material, e.g., an existing well, the magnetic resistance or "reluctance" of the magnetic flux path (or magnetic circuit) for permanent magnet 408 may be reduced. When detector 400 is utilized to sense magnetic reluctance, detector 400 may be termed a "reluctance sensor." A decreased reluctance may allow for a higher volume of magnetic flux to be emitted from permanent magnet 408 around a magnetic circuit. Detector 400 functioning as a reluctance sensor may have increased sensitivity to magnetic field changes when utilizing core 412 with a higher magnetic permeability. Higher magnetic permeability may support higher fluctuations of magnetic flux for a given magnetic circuit reluctance. Magnetic flux present in a magnetic circuit may be measured in Webbers.

Coil 410 may be located around core 412. Coil 410 may be mounted on a bobbin (not expressly shown), for ease of manufacture, or wrapped directly onto core 412. Coil 410 may be magnetic wire in that it is used for detecting magnetic flux changes in a winding. In some embodiments, coil 410 may be configured to maximize the number of turns on the bobbin (not expressly shown) and/or core 412 to optimize performance of detector 400. For example, coil 410 may be formed in layers to approximately fill the radial space in cavity 422. Coil 410 may include insulation and a conductor. For example, coil 410 may be varnish coated round copper wire. As another example, coil 410 may include square silver or copper drawn wire with a thin dielectric coating on it like PEEK (polyimide), Teflon, GORE insulated wires, a ceramic such as utilized in CERMAWIRE, and/or any other suitable wire and insulation. Selection of coil 410 material may be partially based on high temperatures associated with assembly of instrumented cutting element 428, e.g., brazing temperatures. For example, CERMAWIRE may suitably withstand brazing temperatures during assembly of instrumented cutting element 428. Utilizing a square cross section conductor may reduce coil resistance per turn as compared with a round conductor based on increased area of the conductor, however, square cross section conductors may be cost prohibitive. In some embodiments, coil 410 may utilize a thermal insulator, such as a ceramic tube, to protect coil 410 and other components internal to detector 400 while brazing or other connection operation occurs to connect cutting table 404 and substrate 402. In some embodiments, the insulating material may be in the shape of a hollow tube to allow the conductor to connect to connectors 418 on connector cap 406. Selection of material for coil 410 may depend on application specific factors such as temperature, vibration, and/or any other factors that may affect performance of coil 410.

During operation of detector 400, a time varying magnetic flux present in the magnetic circuit emitted by permanent magnet 408 may result in current and voltage measured in coil 410. Core 412 with a higher magnetic permeability may allow a larger range of increased magnetic flux capacity per unit area in the magnetic circuit. Higher rate of time varying change of magnetic flux in core 412 may result in a higher voltage reading from coil 410 that surrounds core 412. Coil 410 may generate voltage based on the formula:

$$V(t)=N^{*}d\phi/dt, \text{ where} \quad (1)$$

N=the number of turns on the coil, $\phi$=the magnetic flux measured in Webbers at a given time, t, in seconds inside the diameter of coil 410, and $d\phi/dt$=the rate of change of magnetic flux over time in Webbers per second inside the diameter of coil 410.

Thus, the voltage measured in coil 410 may depend directly on the rate of change in magnetic flux inside the diameter of coil 410 over time.

Spacer 414 may be located proximate to and/or in contact with core 412.

Spacer 414 may be composed of a material that may not interfere with the magnetic field created by detector 400. For example, spacer 414 may be composed of a non-magnetic material, such as beryllium copper (BeCu), and/or any other suitable material. Spacer 414 may be utilized to encourage magnetic flux leakage from the end of core 412 proximate to permanent magnet 408. In some embodiments, spacer 414 may be a portion or an extension of core 412. Also, spacer 414 may be configured to provide axial support, e.g., support along sense axis 424, to core 412. Spacer 414 may include a hollow center to provide a path for one or more coil wires 420 to pass through from coil 410 to connectors 418 on connector cap 406. Further, one or more other electronics may also be positioned inside spacer 414, such as, a temperature sensor, a capacitor, an amplifier circuit, a weight/force sensor, a vibration sensor, and/or any other suitable electronics to support the function of detector 400.

Connector cap 406 may be located proximate to and/or in contact with spacer 414 and/or substrate 402. Connector cap 406 may include one or more electrical connectors 418. Connector cap 406 may utilize electrical connectors 418 to provide electrical connection and a signal or signals between coil wires 420 and corresponding connections in bit pocket 166 discussed with reference to FIG. 2A and/or bit pocket 366 discussed with reference to FIG. 3. Coil wires 420 may be communicatively coupled with electrical connectors 418 on connector cap 406. Electrical connector 418 may engage one or more mating connectors in the pocket for cutting element 428, e.g., bit pocket 166 discussed with reference to FIG. 2A and/or bit pocket 366 discussed with reference to FIG. 3. Connector cap 406 may be welded, threaded, sealed, and/or connected in any other suitable manner to the end of substrate 402 located approximately opposite from cutting table 404.

In some embodiments, connector cap 406 (as part of instrumented cutting element 428) may be brazed into bit pocket 166 at high temperature. Connector cap 406 may be designed to allow for wicking of the brazing material between instrumented cutting element 428 and bit pocket 166 to optimize the strength of the braze connection. In some embodiments, during the brazing operation, brazing material may be minimized from wicking into the area proximate to connectors 418 by a protective boundary, and/or other suitable material that may minimize the potential for shorting out connectors 418. Such a connection may be termed a "braze free" connection. For example, a protective boundary material, such as a ceramic disk (not expressly shown), may be placed on connector 418. Additional materials may be utilized to aid centering of the ceramic disk on connector 418, such as a compliant layer, e.g., a compressed fiberglass disk, placed between the ceramic disk and connector 418. As another example, a substantially braze free connection may be accomplished by utilizing a recessed receptacle proximate to connector 418 that may mate with a pin in bit pocket 166 to effect a connection.

In some embodiments, a single wire 420 from coil 410 may be connected to connectors 418 with an associated ground return through the bit body, e.g., bit body 124 shown with reference to FIG. 2A and/or tubular body 634 shown with reference to FIG. 3. In another embodiment, two or more wires 420 from coil 410 may be utilized to provide a separate ground return wire and/or assist in controlling sensor noise.

In some embodiments, the brazing operation to connect instrumented cutting element 428 with bit pocket 166 may cause permanent magnet 408 to be in a unmagnitized state, e.g., if permanent magnet 408 is heated above its curie temperature. To re-magnetize permanent magnet 408, an external magnetic field may be applied as permanent magnet 408 cools from the brazing operation to encourage the magnetic domains in the magnet to realign and thus re-magnetize. As another example, the external magnetic field may be applied in a separate reheating process in which permanent magnet 408 may be heated above its curie temperature but remain below the braze material melting temperature. Thus, in some embodiments, permanent magnet 408 may be construted of a material with a curie temperature above the brazing temperature, e.g., a samarium-cobalt magnet.

In some embodiments, an alternative to permanent magnet 408 may be utilizing an electromagnet that may be powered by energizing a second coil (not expressly shown) around a separate core (not expressly shown) within detector 400 or a separate coil around portions of existing core 412. The magnetic axis of a separate core may be approximately coincident and/or integral with core 412. The electromagnet may be powered with a direct current. The second coil may be utilized for sensing a change in magnetic circuit reluctance rather than permanent magnet 408. In this embodiment, two coil wires 420 may be utilized to connect the electrical circuit with connectors 418. Operation of the electromagnet may include selectively activating, e.g., applying direct current, to the separate coil to support a reluctance sensor. Alternatively, the separate core may be demagnetized (de-guassed) by the separate coil to alter the magnetizing field to near zero. In this case, detector 400 may then be electronically reconfigured to operate as an inductance sensor, as discussed below with reference to FIG. 6.

Configuration of detector 400 may be varied to generate an optimal response to the presence of a magnetizable material, e.g., casing 134 shown with reference to FIG. 1, in proximity to detector 400, as discussed in more detail with reference to FIGS. 5A and 5B. For example, the location of permanent magnet 408, the number of windings in coil 410, and/or other aspects of detector 400 may be adjusted to generate a response of the magnetic circuit to the proximity of an existing well and/or other magnetizable material. As another example, detector 400 may be tuned to a desired detectable distance or range by varying the amount of magnetizable material in detector 400 and/or shape of detector 400, e.g., to effect a change in magnetic flux as the external magnetizable material comes within the effective range of detector 400. As such, a plurality of different configurations exist for construction of the magnetic circuit and emission of the magnetic flux from the permeable flow path into detector 400 surroundings.

Figure 5A:
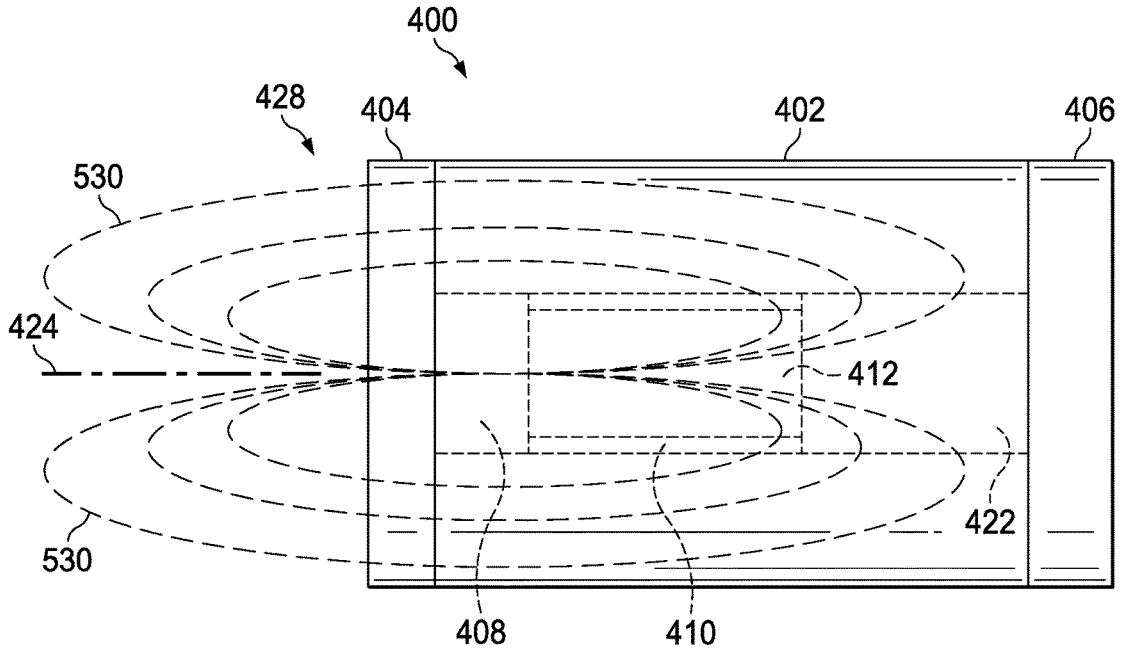
FIG. 5A illustrates an exemplary magnetic field that may occur during operation of the detector shown in FIG. 4 in the substantial absence of external magnetizable material, e.g., an existing well and/or other downhole obstruction, in accordance with some embodiments of the present disclosure.

FIG. 5A illustrates an exemplary magnetic field 530 that may occur during operation of detector 400 shown in FIG. 4 in the substantial absence of external magnetizable material, e.g., an existing well and/or other downhole obstruction, in accordance with some embodiments of the present disclosure. Magnetic field 530 may include magnetic poles defining the magnetic moment of the magnetic source, which may be co-axial with a permeable core and/or a magnetic source. In the substantial absence of external magnetizable material, such as ferromagnetic materials, magnetic field 530 may be generally symmetrical. However, magnetic field 530 may interact with bit body 124, blades 126, and/or other components of drill bit 101 shown in FIG. 2A and/or tubular body 324, blades, 326, and/or other components of tool 320 shown in FIG. 3, if any such components comprise magnetizable material. Such interaction may affect the shape, size, and/or symmetry of magnetic field 530, and/or impact the magnetic flux density of the magnetic circuit created by the proximity of external magnetizable material. Magnetic flux density may be expressed in units of Webbers per square meter ($Wb/m^2$).

Figure 5B:
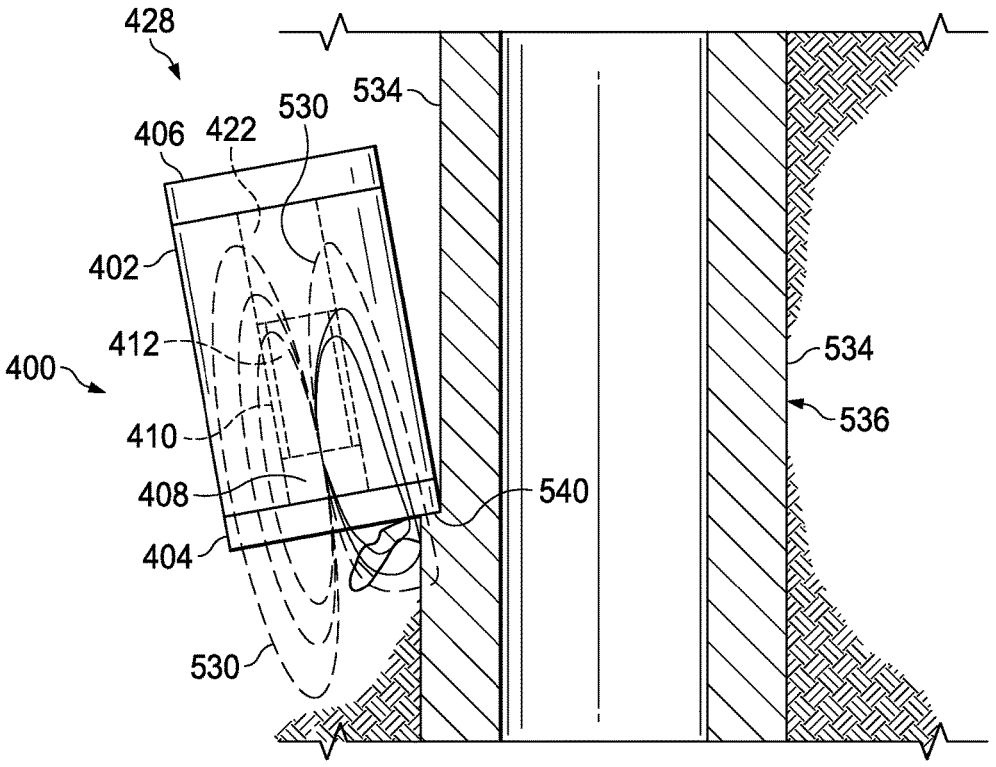
FIG. 5B illustrates an exemplary magnetic field for the detector shown in FIG. 4 in the situation where a drill bit may contact an existing well, in accordance with some embodiments of the present disclosure.

FIG. 5B illustrates an exemplary magnetic field 530 for detector 400 shown in FIG. 4 in the situation where drill bit 101 and/or tool 320 may contact existing well 536, in accordance with some embodiments of the present disclosure. As instrumented cutting element 428 becomes proximate to and/or contacts casing 534 of existing well 536 at contact point 540, magnetic field 530 may be altered. Alteration of magnetic field 530 may occur in the presence of magnetizable material, e.g., casing 534. Thus, both casing 534 and the shavings from casing 534 may cause a change in magnetic field 530. During operation, when cutting table 404 of instrumented cutting element 428 approaches an external magnetizable material, such as casing 534, the reluctance of the magnetic circuit for permanent magnet 408 may be reduced. A decreased reluctance may allow for a higher volume of magnetic flux to be emitted from permanent magnet 408 around the magnetic circuit loop shown by magnetic field 530. If surrounding rock formations are weakly magnetizable or non-magnetic, the reluctance may increase when instrumented cutting element 428 is not proximate magnetizable material, e.g., casing 534. Hence, reluctance may vary depending on the position of instrumented cutting element 428 relative to the magnetizable material. Variance in reluctance may cause a variance in magnetic flux density through the magnetic circuit.

As noted above, in some embodiments, as the reluctance decreases the magnetic flux that is emitted around the magnetic circuit may increase. As instrumented cutting element 428 with detector 400 nears proximate to casing 534, the magnetization effects of casing 534 may reduce the reluctance and the magnetic flux present in the magnetic circuit increases. As instrumented cutting element 428 with detector 400 moves away from casing 534, the reluctance increases and the magnetic flux in the magnetic circuit decreases. Thus, magnetic flux and magnetic flux density in the magnetic circuit may vary based on time and may be in part a function of the rotation speed of a drill bit. Since a majority of the magnetic flus may pass through core 412, there may be a time varying rate of change of magnetic flux density in core 412 surrounded by coil 410. As detailed with reference to equation (1) above, the resultant voltage from coil 410 may be dependent on the number of turns of coil 410 multiplied by the time rate of change of magnetic flux through coil 410 ($d\phi/dt$). Thus, voltage from coil 410 may be dependent the amount of variance in the magnetic circuit effects created by the magnetizable target, e.g., casing 534, which is essentially dependent upon the target's relative permeability ($\mu_r$). A target with high magnetic permeability (e.g., iron based material, which may be a typical material for casings and drill strings, may have a high magnetic permeability of up to approximately three thousand) may decrease the reluctance in the magnetic circuit and increase the magnetic flux.

Accordingly, the alteration of magnetic field 530 may change the magnetic reluctance of the magnetic circuit, which changes the amount of magnetic flux and magnetic flux density passing through the inner region of coil 410 with each rotation of drill bit 101 and/or tool 320. A higher magnetic flux density or time variance of magnetic flux density in the magnetic circuit may indicate the presence of magnetizable or ferromagnetic material, e.g., casing 534. Additionally, a variance in magnetic flux density may be evidenced by an increase incurrent flowing in coil 410 and/or may be evidenced by a change in a voltage reading across coil 410 end wires. The illustrated change in magnetic field 530 is merely exemplary and more, less, and/or any other variation of change may occur that may be detected by detector 400. Thus, the presence of voltage across coil 410 end wires may be indicative of a variance in the magnetic circuit reluctance. The varying voltage may constitute a signal indicating the presence and absence of a magnetizable material in proximity to detector 400. The voltage signal may subsequently resemble the derivative of the variation over time of the magnetic flux density in core 412 of detector 400.

Figure 5C:
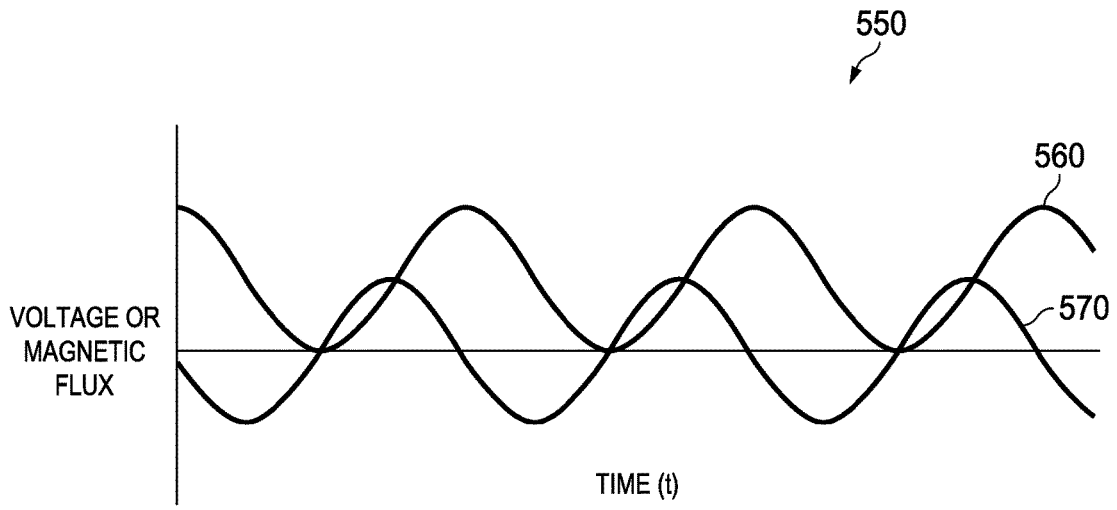
FIG. 5C illustrates a graph of an exemplary time varying response of a detector as the detector drifts proximate to and away from a magnetizable material, in accordance with some embodiments of the present disclosure.

FIG. 5C illustrates graph 550 of an exemplary time varying response of detector 400 as detector 400 drifts proximate to and away from a magnetizable material, in accordance with some embodiments of the present disclosure. Plot 560 may represent the time variance in magnetic circuit flux density. Plot 570 may represent the time varying voltage detected by coil 410. Note that the voltage, e.g., plot 570, may be the derivative signal of the varying flux in core 412. e.g., plot 560. In operation, the sensed voltage may resemble momentary spikes as detector 400 comes proximate to the magnetizable material. The sensed voltage may be digitized and analyzed by a downhole processor, e.g., in drill bit 101 and/or tool 320, that may include instructions on what constitutes a magnitizable body within the detection range of sensor 400.

Figure 5D:
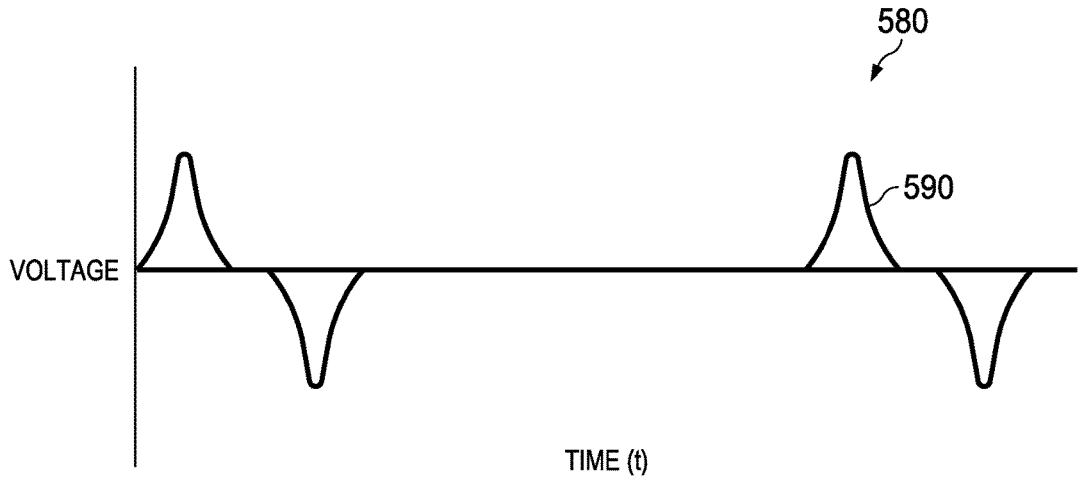
FIG. 5D illustrates a graph of an exemplary time varying voltage response as a detector drifts proximate to and away from a magnetizable material, in accordance with some embodiments of the present disclosure.

FIG. 5D illustrates graph 580 of an exemplary time varying voltage response as detector 400 drifts proximate to and away from a magnetizable material, in accordance with some embodiments of the present disclosure. Plot 590 may be an exemplary response of the variable reluctance sensor voltage output from coil 410. The positive spikes in plot 590 may illustrate the response as sensor 400 comes proximate to magnetizable material and the negative spikes may illustrate the response as sensor 400 moves away from the magnetizable material while sensor 400 rotates with drill bit 101 and/or tool 320.

Returning to FIG. 5B, in some embodiments, a change in magnetic flux density in instrumented cutting element 428 may cause changes to current flow and voltage output of coil 410. For example, a change in magnetic flux density may be evidenced by an increase in current flowing to coil 410, and thus, a change in the voltage output of coil 410. The current may be detected by a detection circuit located in drill bit 101 and/or BHA 120 shown in FIG. 1 and/or tool 320 shown in FIG. 3. The detection circuit may be coupled via an electrical pathway to electrical connectors 418 on connector cap 406 of instrumented cutting element 428. When the detection circuit detects the presence of the shavings, casing 534 and/or other magnetizable or manmade material, the detection circuit may transmit the data to well site 106 via components of BHA 120 and/or any other downhole telemetry system. This transmission may alert users that drill bit 101 and/or tool 320 may be intersecting an obstruction that is magnetizable and/or may be intersecting existing well 536, abandoned drill string, and/or other magnetizable or manmade material. Alternately or in addition, a fail safe mechanism may be triggered that may, at least temporarily, rotationally decouple drill bit 101 and/or tool 320 from drill string 103 rotation and substantially or completely stop further cutting into casing 534. For example, a locking swivel located uphole from drill bit 101 and/or tool 320 may be activated that may disengage torque from being transmitted to drill bit 101 and/or tool 320 from drill string 103. The locking swivel may be actuated by an internal controller (not expressly shown) in response to signals from detector 400. The internal controller may be any type of suitable controllers, or processors that may be communicatively coupled to drill string 103, drill bit 101, and/or tool 320. The internal controller may provide real-time control to any component of drill string 103 and/or BHA 120, including control of any electric motor, clutch, torque control, and/or any other suitable component. In some embodiments, the internal controller may be located at the surface. In some embodiments, the internal controller, may be located downhole. The internal controller may include one or more processing units that may be distributed within the elements of drill string 103. The internal controller may control the current, voltage available, motor speed, clutch engagement and/or torque capacity to any component of drill string 103, BHA 120, drill bit 101, and/or tool 320.

As another example, in the event rotation is only by a mud motor or turbodrill vane motor, a valve may open that diverts the drilling fluid away from the power section of the mud motor or turbodrill. As a further example, if the rotational power is provided for by a downhole electric motor, power to the motor may be automatically or manually removed. Any other suitable method for rotationally decoupling drill bit 101 and/or tool 320 may be utilized.

Further, during rotation of drill bit 101 and/or tool 320, the azimuthal location of the magnetizable or manmade material relative to the high side the wellbore may be determined by monitoring detector 400 response as detector 400 sweeps arc length segments of the wellbore. The high side of a wellbore may refer to the top of the hole relative to the down direction. Using a high side reference sensor in drill bit 101 and/or tool 320, such as an orthogonal pair of accelerometers positioned to measure the cross-axis directions (X and Y) across the wellbore, an internal controller may store the sensor response relative to a segment of arc length of the rotation. Such a response may assist in monitoring the direction of the magnetizable and/or manmade material relative to the high side of the wellbore. For example, with rotation in just one direction, such as to the right, then one cross-axis accelerometer may be necessary to approximate the angular position of drill bit 101 and/or tool 320 as a function of time during rotation. Detector 400 values may be binned into segmented arc length slots of rotational angle, for example, five degree increments in rotational angle, relative to a reference point. The internal controller, detector 400, and/or any other suitable component may then facilitate transmission to surface the direction of magnetizable material and/or a manmade object. Moreover, the internal controller may modify downhole steering of a controllable steering assembly autonomously using detector 400 data if drilling is to continue. For example, a steering assembly may guide itself based on predetermined or updated instructions in response to the determined approximate location of magnetizable and/or manmade material. As another example, a gyroscope may also be utilized to update steering instructions if the gyroscope maintains a reference direction while the drill bit is rotated. Examples of gyroscopes may include a rate gyroscope, a north seeking gyroscope, and/or a gyroscope that may be constructed as a solid state gyroscope, such as a microelectronic machine (MEM), spinning mass and/or any other gyroscope sensor platform. By utilizing a directional sensing component, drill bit 101 and/or tool 320 may steer to intersect, avoid, or follow the magnetizable material and/or man-made object.

Thus, use of detector 400 in instrumented cutting element 428 may contribute to detecting the presence of a casing, liner, sand screens, and/or lost in hole fish in another existing well and/or other ferromagnetic and/or current conducting object at instrumented cutting elements 428. In other scenarios, detector 400 in instrumented cutting element 428 may aid in avoiding previously drilled structures in the same wellbore as is currently being drilled, e.g., in a side track where a lost in hole fish exists in a previously drilled segment of the well being drilled and/or in a multilateral application where at least one branch wellbore extends from a central wellbore. Use of detectors 400 may additionally alert users when drill bit 101 and/or tool 320 is about to drill into a live well close to surface. Further, detection of magnetizable materials, such as ferromagnetic materials, may help to prevent damage to drill bit 101 and/or tool 320 and/or the object about to be contacted.

Notably, earth formations may also exhibit variations in magnetizable characteristics. For example, pyrite ($FeS_2$) may have a relative magnetic permeability of approximately thirty. As drill bit 101 and/or tool 320 approaches or leaves a bed of pyrite, a spike in voltage may be observed in the reluctance sensor coil 410 because the magnetic circuit is changing as instrumented cutting element 428 moves from one formation into another of varying magnetic permeability. However, while transitioning through a pyrite zone, no noticeable change in reluctance may be sensed. Thus, the reluctance sensor may be utilized for detecting bed boundaries of magnetically responsive formations by the reluctance sensor moving periodically into and out of such a formation. For example, at the bed boundary or across a formation fault, there may be at least part of the rotation of drill bit 101 and/or tool 320 that exhibits a variance in the sensed permeance of the formation by the reluctance sensor.

Additionally, specific types of earth formations may be referred to as paramagnetic in that they are not strongly magnetic. For example, relative magnetic permeability of paramagnetic formation types may include montmorillonite (clay) at approximately thirteen, nontronite (Fe-rich clay) at approximately sixty-five, biotite (silicate sand) at approximately one hundred, and siderite (carbonate) at approximately one hundred. Thus, the reluctance sensor may be calibrated to distinguish the response levels to aid in identifying the type of formation being drilled. Identification of formation types may allow "geo-steering" based on reluctance sensor response, e.g., varying wellbore 114 direction based on sensed boundary layers as geological markers. Further, the sensed boundary information may be compared against offset well information for the area and enable accurate determination of wellbore bottom relative to the surrounding formation stratifications. Other formation types may exist that exhibit a response that are relatively more magnetizable such as iron ores, e.g., magnetite ($Fe_3O_4$), hematite ($FeO_3$), goethite ((Fe)(OH)), limonite (FeO(OH).n ($H_2O$)), or siderite ($FeCO_3$).

In some embodiments, detectors 400 may be utilized on packers or liner hangers. A packer may be utilized to isolate zones inside a wellbore or a well casing, e.g., a bridge plug, or may be utilized at the bottom of a casing or liner, e.g., a cement plug. A liner hanger, which may have a central through bore, may be used to position a string of pipe for well completions. A string of pipe may be coupled to the liner hanger inside another string of pipe at some point below the well site. In some embodiments, detector 400 may be utilized to determine if a packer or liner hanger is in a correct and/or suitable location. A landing collar for a packer or liner hanger may have a wall thickness greater than the wall thickness of an associated drill pipe. Thus, a landing collar may exhibit a higher magnetic permeance that the associated drill pipe, and detector 400 may assist in determining if the packer or liner hanger is in the appropriate location, e.g., relative to the landing collar, and/or if the packer or liner hanger is partially or completely seated with respect to the landing collar. For example, a work string used to set the packer or liner hanger may be fitted with a telemetry interface module to permit detector 400 data to be transmitted via mud pulse, wired pipe and/or any other means of telemetry. Further, the location of a packer or liner hanger may be tracked as the packer travels by casing collars, which have a higher magnetic permeance than other portions of the wellbore. Hence, the number of casing joints the packer or liner hanger has traversed may be monitored.

Figure 6:
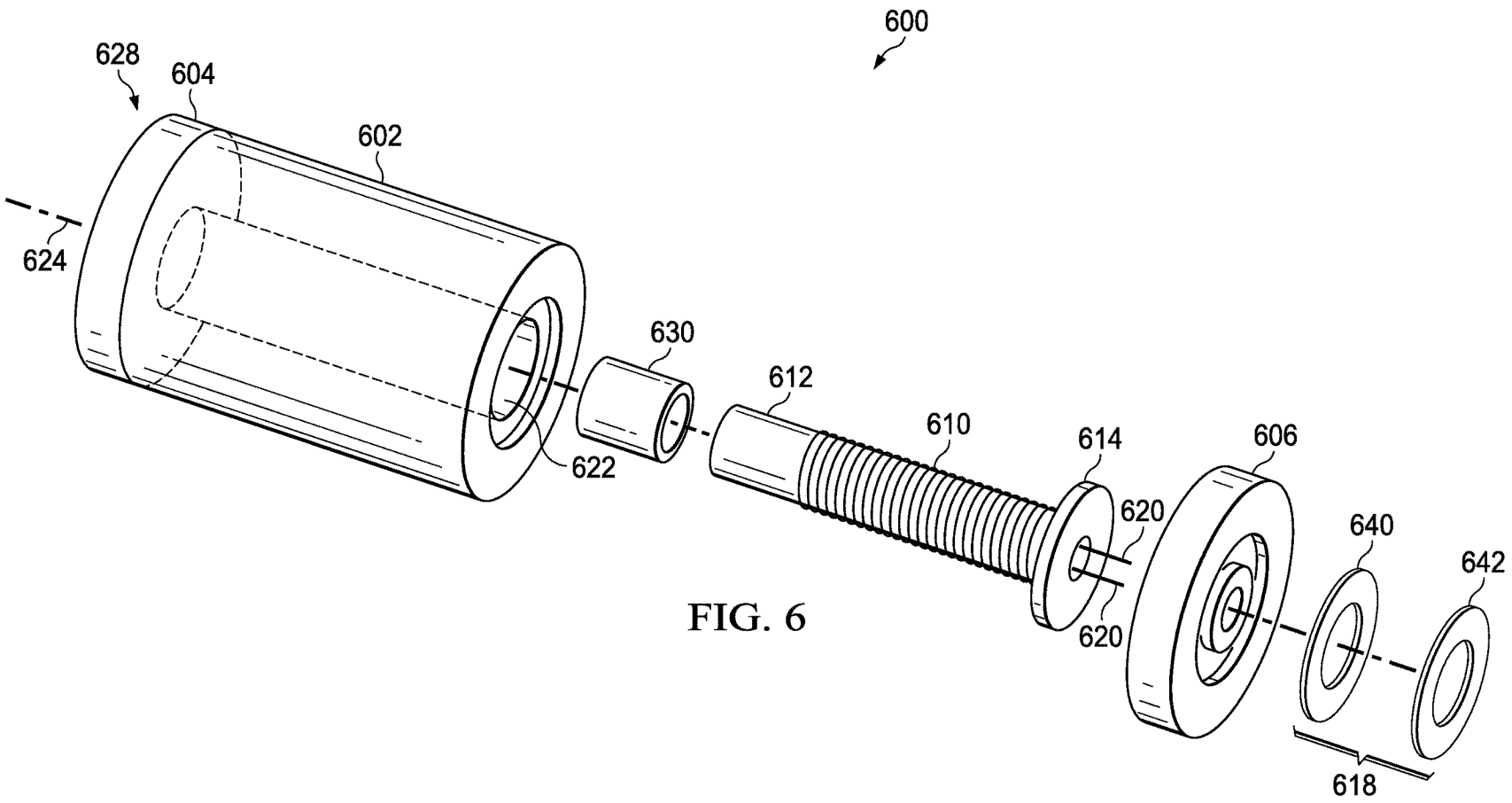
FIG. 6 illustrates an exploded view of a detector configured to be located in an instrumented cutting element and function as an inductance sensor, in accordance with some embodiments of the present disclosure.

FIG. 6 illustrates an exploded view of detector 600 configured to be located in instrumented cutting element 628 and function as an inductance sensor, in accordance with some embodiments of the present disclosure. A particular cutting element that includes detector 600 may be referred to as instrumented cutting element 628. Detector 600 in instrumented cutting elements 628 may allow measurement of the resistivity and/or conductivity of the formation in front of and around instrumented cutting element 628 during operation of the drill bit, e.g., drill bit 101 shown in FIG. 1 and/or tool 320 shown in FIG. 3. When detector 600 is utilized to measure conductivity of a formation, detector 600 may be termed an "induction sensor" (rather than a reluctance sensor discussed with reference to FIGS. 4, 5A and 5B, which may necessitate a magnetic source such as permanent magnet 408).

For an inductance sensor, coil 610 (and/or associated bobbin) may be configured such that coil 610 may be energized by electric current. The current source may then be removed and a capacitor in parallel with coil 610 may be switched into the electric circuit. The resultant stored energy in coil 610 may be released and result in an amplitude decaying ringing effect, e.g., ring-on frequency and amplitude. The ringing effect may be measured, digitized, and/or processed by an internal controller or any other suitable component. The ringing effect in cooperation with a capacitor that may either added to detector 600 or located in bit body 124 may form an electrical tank circuit. The frequency and amplitude characteristics of the ringing effect after the current is removed from coil 610 may vary depending on the surrounding conductivity of the rock formation. Many variations on this method may exist and could include thermal compensation, among other suitable variations. By monitoring the variance in the ring-on frequency and amplitude, the conductivity of the rock near instrumented cutting elements 628 may be inferred. The tank circuit may consist of coil 610 and a capacitor (not expressly shown). The circuit is excited by an impulse from one or more switches that disengage and engage to allow for current to loop between coil 610 and the capacitor (not expressly shown). The output voltage from the tank circuit may be measured and correlated to magnetizable properties of the surrounding formation. Further, eddy currents may be induced and measured within the surrounding formation based on changes in the magnetic field to provide details regarding the formation proximate to detector 600.

In the present embodiment, cutting table 604 (similar to cutting table 162 shown in FIG. 2A and/or cutting table 362 shown in FIG. 3) may be a PDC cutting table. Substrate 602 (similar to substrate 164 shown in FIG. 2A and/or substrate 364 shown in FIG. 3) may be composed of tungsten carbide with a cobalt binder. Substrate 602 may include cavity 622. Cavity 622 may be machined in substrate 602, created with the use of an electro discharge machine (EDM) process, utilizing a cast to create cavity 622, and/or manufactured with any other suitable method based in part on the conductivity, hardness and/or any other property of substrate 602.

Cavity 622 may extend entirely through substrate 602, e.g., contacting cutting table 604, or cavity 622 may not extend to contact cutting table 604 and may allow for a non-cavity segment of substrate 602 to exist in contact with cutting table 604. Alternatively, cutting table 604 may extend the cavity by including a matching cavity in cutting table 604 in part or in whole of the axial length of cutting table 604.

In some embodiments, to minimize magnetic interference, it may be advantageous to minimize the magnetic permeability of other materials used in the manufacture of detector 600. As example, cobalt, which may be used as a binder in substrate 602, may act as a magnetic short circuit (e.g., cause magnetic interference) in operation of detector 600. As a result, at least a portion of substrate 602 may optimally contain a different binder agent. Elimination of cobalt from substrate 602 proximate cutting table 604 may be challenging due to the manufacturing process for cutting table 604. For example, cobalt may wick up proximate to and/or into cutting table 604 during formation. Other materials that are weakly magnetic or non-magnetic (e.g., have a $\mu_r$ approximately equal to one) may be substituted for cobalt in formation of substrate 602. For example, other slightly magnetic binders may include tungsten alloys containing Ni—Fe binders, and/or relatively non-magnetic binders may include tungsten alloys containing Ni—Cu. As noted above with reference to FIG. 4, these tungsten alloys may be defined in various ASTM and SAE standards. As another example, substrate 602 may be manufactured with a non-magnetic material such as an austenitic stainless steel.

In some embodiments, cutting table 604 may also be manufactured utilizing a low magnetic or a non-magnetic binder. Using low magnetic or non-magnetic binders may further reduce the possibility of magnetic short circuiting or magnetic interference during operation of detector 600. For example, a Cu—Mn—Ni—Zn alloy may be utilized as a binder for cutting table 604. The Cu—Mn—Ni—Zn alloy is a non-magnetic/low magnetic binder. Further, the Cu—Mn—Ni—Zn alloy may also be utilized as a binder in substrate 602.

In some embodiments, detector 600 may not employ a permanent magnet, such as permanent magnet 408 shown with reference to FIG. 4. In place, non-conductive cap 630 may be placed in cavity 622 close to cutting table 604. Core 612 may insert into a hollow center in non-conductive cap 630 or may be configured flush to the end of non-conductive cap 630 substantially opposite from cutting table 604. In another embodiment, non-conductive cap 630 may not be included in detector 600. In such a configuration, coil 610 may be placed proximate to cutting table 604 to maximize the magnetic flux density exiting cutting table 604 as the current oscillates in the tank circuit.

In some embodiments, core 612 may be located proximate and/or in contact with non-conductive cap 630 and/or cutting face 604. Core 612 may be composed of a material that may have a high magnetic permeability. For example, core 612 may be composed of a ferrite. Core 612 may include more than one type of alloy to support a variable magnetic flux density ($Wb/m^2$) when exposed to variations in the current of the tank circuit.

Coil 610 may be located around core 612. Coil 610 may be mounted on a bobbin (not expressly shown), for ease of manufacture, or wrapped directly onto core 612. Coil 610 may be magnetic wire in that it is used for detecting magnetic flux changes in a winding. In some embodiments, coil 610 may be configured to maximize the number of turns on the bobbin (not expressly shown) and/or core 612 to optimize performance of detector 600. Coil 610 may include insulation and a conductor. For example, coil 610 may be varnish coated round copper wire. As another example, coil 610 may include square silver or copper drawn wire with a thin dielectric coating on it like PEEK (polyimide), Teflon, GORE insulated wires, a ceramic such as utilized in CERMAWIRE, and/or any other suitable wire and insulation. Selection of coil 610 material may be partially based on high temperatures associated with assembly of instrumented cutting element 628, e.g., brazing temperatures. For example, CERMAWIRE may suitably withstand brazing temperatures during assembly of instrumented cutting element 628. Utilizing a square conductor may reduce coil resistance per turn as compared with a round conductor based on increased area of the conductor, however, square conductors may be cost prohibitive. In some embodiments, coil 610 may utilize a thermal insulator, such as a ceramic tube, to protect coil 610 and other components internal to detector 600 while brazing or other connection operation occurs to connect cutting table 604 and substrate 602. In some embodiments, the insulating material may be in the shape of a hollow tube to allow the conductor to connect to connectors 618 on connector cap 606. Selection of material for coil 610 may depend on application specific factors such as temperature, vibration, and/or any other factors that may affect performance of coil 610. Further, although FIG. 6 illustrates coil 610 having only one layer of wire thickness, multiple layers of winding wire may be utilized to achieve the optimal inductance for operation of detector 600.

Spacer 614 may be located proximate to and/or in contact with core 612. Spacer 614 may be composed of a material that may not interfere with the magnetic field created by detector 600. For example, spacer 614 may be composed of a non-magnetic material, such as beryllium copper (BeCu), and/or any other suitable material. In some embodiments, spacer 614 may include a magnetizable material such as ferrite or iron based on tuning the magnetic circuit to the desired frequency response Spacer 614 may be utilized to encourage magnetic flux leakage from the end of core 612 proximate to cutting table 604. In some embodiments, spacer 614 may be a portion or an extension of core 612. Also, spacer 614 may be configured to provide axial support, e.g., support along sense axis 624, to core 612. Spacer 614 may include a hollow center to provide a path for one or more coil wires 620 to pass through from coil 610 to connectors 618 on connector cap 606. Further, one or more other electronics may also be positioned inside spacer 614, such as a temperature sensor, a capacitor, an amplifier circuit, a weight/force sensor, a vibration sensor, and/or any other suitable electronics to support the function of detector 600.

Connector cap 606 may be located proximate to and/or in contact with spacer 614 and/or substrate 602. Connector cap 606 may include one or more electrical connectors 618. Connector cap 606 may utilize electrical connectors 618 to provide electrical connection and a signal or signals between coil wires 620 and corresponding connections in bit pocket 166 discussed with reference to FIG. 2A and/or bit pocket 366 discussed with reference to FIG. 3. Coil wires 620 may be communicatively coupled with electrical connectors 618 on connector cap 606. Electrical connector 618 may engage one or more mating connectors in the pocket for cutting element 628, e.g., bit pocket 166. Connector cap 606 may be welded, threaded, sealed, and/or connected in any other suitable manner to the end of substrate 602 located approximately opposite from cutting table 604. Connector cap 606 thereby may allow electric signals and electrical energy to pass between detector 600 and drill bit 101 and/or tool 320 control and monitoring systems.

In some embodiments, connector cap 606 (as part of instrumented cutting element 628) may be brazed into bit pocket 166 at high temperature. Connector cap 606 may be designed to allow for wicking of the brazing material between instrumented cutting element 628 and bit pocket 166 to optimize the strength of the braze connection. In some embodiments, during the brazing operation, brazing material may be minimized from wicking into the area proximate to connectors 618 by a protective boundary, and/or other suitable material that may minimize the potential for shorting out connectors 618. Such a connection may be termed a "braze free" connection. For example, connector 618 may include a protective boundary material, such as ceramic disk 642, that may be placed on compliant member 640. Compliant member 640 may be a compressed woven fiberglass disk that may aid in the alignment of ceramic disk 640 to the bit pocket, e.g., bit pocket 166. As another example, a substantially braze free connection, e.g., reduction of wicking of braze material onto the face of connector 618, may be accomplished by utilizing a recessed receptacle proximate to connector 618 that may mate with a pin in bit pocket 166 to effect a connection while permitting brazing to occur around the diameter of detector 600 and other appropriate areas of connector 618.

In some embodiments, a single wire 620 from coil 610 may be connected to connectors 618 with an associated ground return through substrate 602 and thus the bit body, e.g., bit body 124 shown with reference to FIG. 2A and/or tubular body 324 shown with reference to FIG. 3. A similar electrical path technique may be applied to detector 400 shown with reference to FIG. 4. In another embodiment, two or more wires 620 from coil 610 may be utilized to provide a separate ground return wire and/or assist in controlling sensor noise.

Detector 600 may also be configured to detect property changes of the mud at the bottom of the hole, such as the presence of a pill (a slug of high concentration of high viscosity material). For example, detector 600 functioning as an inductance sensor may sense the mud conductivity as it flows by detector 600. The change in mud conductivity may indicate to the operator or other entity that the pill has arrived at the drill bit, e.g., drill bit 101 shown in FIG. 2A and/or tool 320 shown in FIG. 3. Moreover, detector 600 may be configured to detect the quality of the pill. For example, an expected change in mud conductivity may be compared against the actual change in mud conductivity, which may indicate the degree of dilution of the pill while moving from the surface downhole to drill bit 101 and/or tool 320. If the pill is highly resistive electrically in a generally conductive mud drilling system, then detector 600 may also detect this change in the mud conductivity. In order to execute such a test, drill bit 101 and/or tool 320 may be separated (pulled away from) the bottom of wellbore 114 to allow the pill to flow past and/or around detector 600.

Detector 600 may further be utilized to detect the effectiveness and/or depth of penetration of a mud cake. Depth of mud cake may be measured based on porosity of the sidewalls. Based on measurements, adjustments may be made to increase or decrease the depth of the mud cake. In this case, in a water based mud with adequate free ions, such as dissolved salt, as the mud cake builds up, the electrical resistance of the formation nearest the sidewall changes as the non-conductive cake fills up the pores in the rock and displaces conductive fluid. During rotation, as the drill bit moves past a previously measured point (when tripping or moving the drill string up and down) measurements by detector 600 may be repeated at the same position over time to detect a difference in conductivity of the sidewall. Further, this measurement method may be utilized to measure the fluid mobility and/or porosity of the formation being sensed. Similarly for an oil based or non-electrically conductive mud, the formation resistance may increase as the mud ingresses into the pores of the rock in a zone that contains water with free ions, such as an aquifer of salt water.

In some embodiments, detector 600 in instrumented cutting element 628 may allow accurate detection and transmission of cutting table 604 wear and/or cutting table 604 shape changes while drill bit 101 and/or tool 320 remains downhole. Detector 600 may be configured such that substrate 602 may be a component of the magnetic circuit. As cutting table 604 wears, decreased inductance may be detected by detector 600. Decreased inductance in the magnetic circuit may increase the natural frequency of the inductance tank circuit. Comparing the values of the inductance sensor over time may be an indicator of how much wear the cutting table is experiencing. For example, comparisons may be made against known wear models to determine the amount of wear a particular frequency shift may represent.

Further, based on the direction that drill bit 101 and/or tool 320 is drilling into wellbore 114, sense axis of a detector may be positioned in different directions, for example, to take advantage of the fact that the direction of wellbore 114 may be progressing approximately cross-axis or perpendicular to the sense axis of the instrumented cutting element. For example, detector 400 orientation may be configured in the direction of rotation of drill bit 101 and/or tool 320. As another example, detector 400 orientation may be configured in the direction of the new hole being cut. As still another example, a detector with magnetic flux alignment exiting the face of the cutter may only be sensing a portion of what is in front of drill bit 101 and/or tool 320 because sense axis 424 may be focused tangential to wellbore direction. Thus, angles of the sense axis of the detector and the direction the drill bit is drilling may be taken into account in determining detector orientation. In sum, placement of detector 400 and 600 in instrumented cutting elements 428 and 628, respectively, may allow detection and transmission of a wide variety of downhole conditions not currently available.

Figure 7A:
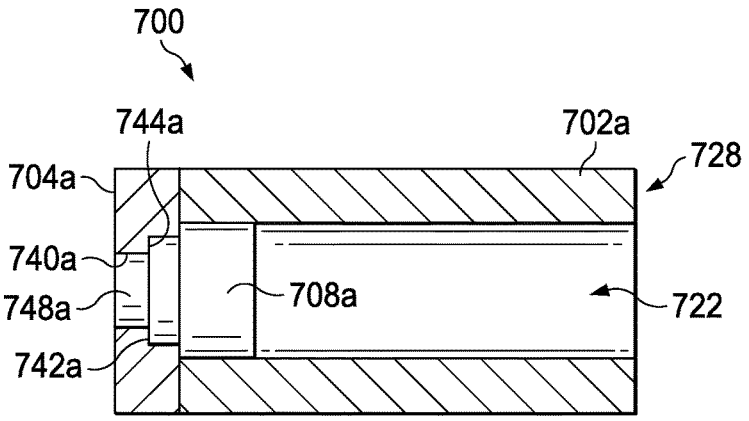
FIGS. 7A-7C illustrate examples of core caps for use with a detector and a cutting table, in accordance with some embodiments of the present disclosure.
Figure 7B:
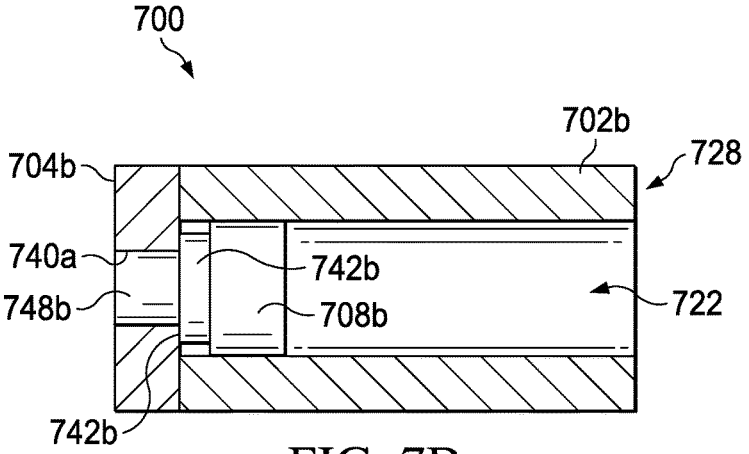
Figure 7C:
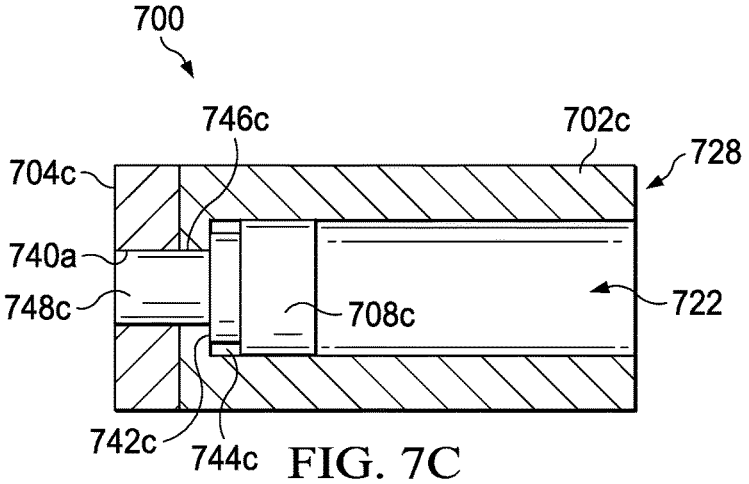

FIGS. 7A-7C illustrate examples of core caps 708 for use with detector 700 and cutting table 704, in accordance with some embodiments of the present disclosure. Detector 700 as part of instrumented cutting element 728 may be similar to detector 400 and instrumented cutting element 428 shown with reference to FIGS. 4, 5A and 5B and/or similar to detector 600 and instrumented cutting element 628 shown with reference to FIG. 6. In some embodiments, cutting tables 704*a*-704*c*, collectively referred to as cutting table 704, may include table bores 740*a*-740*c*, collectively referred to as table bore 740, into which core caps 748*a*-748*c*, collectively referred to as core cap 748, may be located. Core cap 748 may comprise a similar material to substrates 702*a*-702*c*, collectively referred to as substrate 702, e.g., tungsten carbide with a binder, such as cobalt, or another suitable material. In some embodiments, core caps 748 may be a continuation of the cutting table itself (without table bore 740). For a reluctance sensor, e.g., similar to detector 400, core cap 748 may be constructed of a magnetic permeable material that may have abrasion resistant properties and a high yield strength. For example, core cap 748 may be constructed of iron or an iron alloy such as a CoFe based alloy, tungsten carbide with a cobalt binder, and/or any other suitable material. Use of core cap 748 may extend the magnetic path of the permanent magnet allowing the magnetic field to be conducted by core cap 748 as opposed to a solid cutting table 704, which may not provide any conduction assistance. Allowing the magnetic field to be conducted in the same plane as cutting table 704 may increase the magnetic flux density, may increase the sensitivity and range of detector 700, and/or ability of detector 700 to detect magnetizable materials.

In operation of drill bit 101 and/or tool 320, cutting table 704 may become delaminated or separated from substrate 702 due in part to heat causing substrate 702 to expand at a different rate than cutting table 704. Additionally, the presence of cobalt in cutting table 704 (from the manufacturing process) may cause thermal expansion stresses that may result in decoupling of portions of cutting table 704 from substrate 702. Thus, the difference in expansion rates may cause stresses on the interface between cutting table 704 and substrate 702. In some embodiments, introducing table bore 740 may relieve stresses in the area surrounding table bore 740.

Further, core cap 748 may be located with sufficient clearance from table bore 740 such that as core cap 748 expands, it may not introduce substantial stresses into cutting table 704. Any space between cutting table 704 and core cap 748 may be filled with a filler (not expressly shown) that may be a low compression strength material to yield and compress as expansion occurs. For example, the filler may be a high temperature epoxy, Teflon, PEEK, rubber, and/or any other suitable material. The filler may be installed before or after detector 700 has been brazed to drill bit 101 and/or tool 320. Additionally, axial support for core cap 748 may be provided by placing an insulated spacer (not expressly shown) between cutting table 704 and core cap 748. Brazing core cap 748 to substrate 702 and/or permanent magnet 708 may provide support for core cap 748. Axial support may also be provided by placing a supporting spacer (not expressly shown) between the core cap 748 and substrate 702. The supporting spacer may be insulated or non-insulated and may be brazed to substrate 402, and/or any other suitable supporting method or apparatus.

In FIG. 7A, core cap 748*a* may be located to be essentially flush against permanent magnet 708*a*. Core cap 748*a* may include extension 742*a* that corresponds to notch 744*a* in cutting table 704*a*. Extension 742*a* and notch 744*a* may be configured to provide axial support to core cap 748*a*.

In FIG. 7B, core cap 748*b* may be configured with extension 742*b* located flush to cutting table 704*b*. In this embodiment, cutting table 704*b* may include a single bore and no requirement for a notch.

In FIG. 7C, core cap 748*c* may be configured with extension 742*c*. Extension 742*c* may correspond to notch 744*c* in substrate 702*c*. In this embodiment, cutting table 704*c* may include a single bore and no requirement for a notch. Further, core cap 748*c* may additionally be configured to pass through bore 746*c* in substrate 702*c*.

Figure 8:
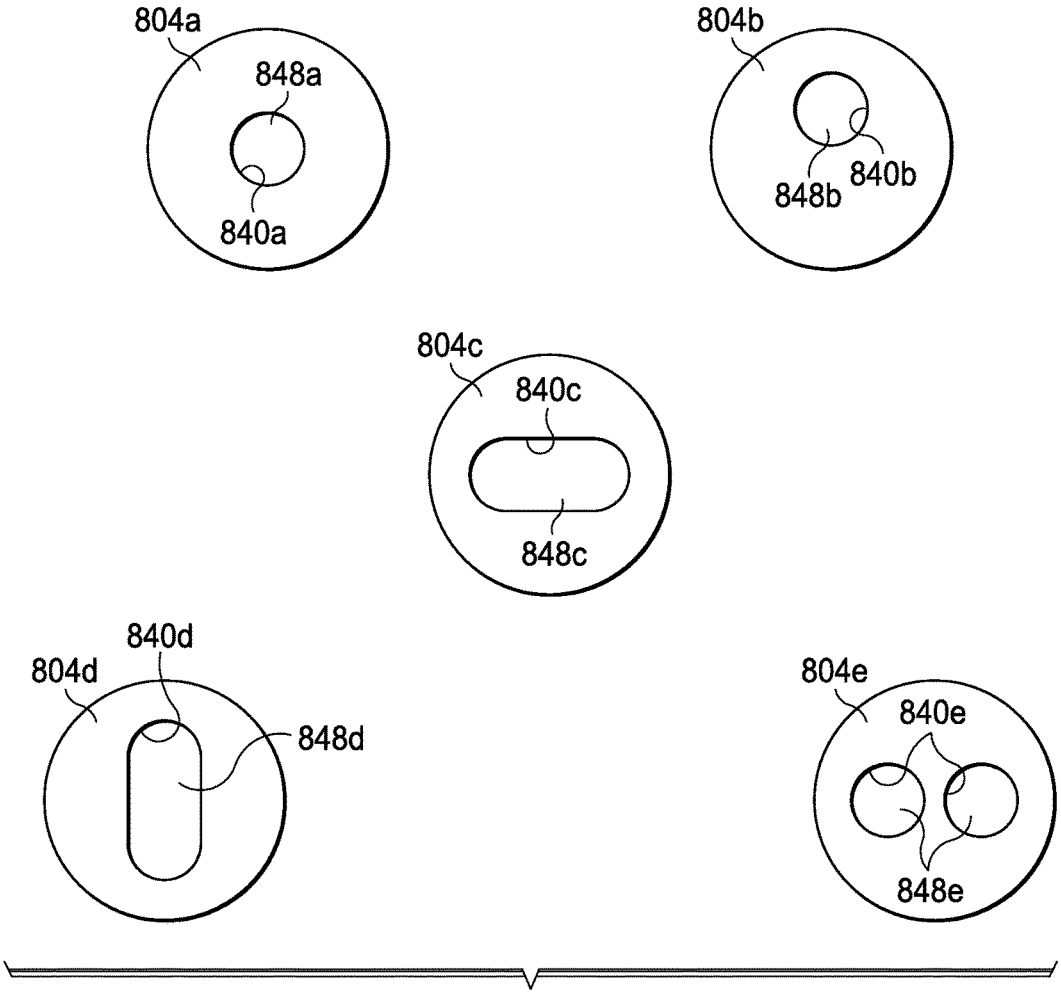
FIG. 8 illustrates examples of faces of cutting tables with core caps for use with the detectors shown in FIGS. 7A-7C, in accordance with some embodiments of the present disclosure.

FIG. 8 illustrates examples of faces of cutting tables 804 with core caps 848 for use with detectors 700 shown in FIGS. 7A-7C, in accordance with some embodiments of the present disclosure. It should be noted that each of the configurations of FIG. 8 may also be located in substrate 702 (shown in FIGS. 7A-7C) and may not extend through the face of cutting table 804. Core caps 848*a*-848*e*, collectively referred to as core cap 848, may be configured in a variety of shapes and locations with reference to cutting table 804*a*-804*e*, collectively referred to as cutting table 804. For example, core caps 848*a* and 848*b* may be essentially circular. While core cap 848*a* may be located approximately in the center of cutting table 804*a*, core cap 848*b* may be located off center with respect to cutting table 804*b*. Placement of core cap 848*b* off center and further from the cutting edge of cutting table 804*b* (1) may allow core cap 848*b* to exhibit less sensitivity to changes in magnetic flux density than core cap 848*a*, and (2) may permit the detector, e.g., detector 700 from FIGS. 7A-7C, to operate in cutting element 728 for an extended period before wearing of cutting table 804*b* reaches core cap 848*b*. Additionally, the configuration illustrated in cutting table 804*b* may necessitate that the associated cavity, e.g., cavity 722 shown in FIGS. 7A-7C, be offset from center.

Core caps 848*c* and 848*d* may be elongated circles and may be located approximately through the center of cutting tables 804*c* and 804*d*. Configuring core cap 848*c* and 848*d* as elongated circles may increase the size of the magnetic field resulting from core caps 848*c* and 848*d*. Core cap 848*c* may be oriented essentially horizontal with respect to placement of cutting table 804*c*, while core cap 848*d* may be essentially vertical with respect to placement of cutting table 804*d*. Core caps 848*e* may be essentially circular and may be located essentially horizontally adjacent and approximately in the center of cutting table 804*e*. Thus, core cap 848 may not necessarily be positioned near the center of the instrumented cutting element, and may not necessarily be round in shape but may assume any geometric shape.

Figure 9A:
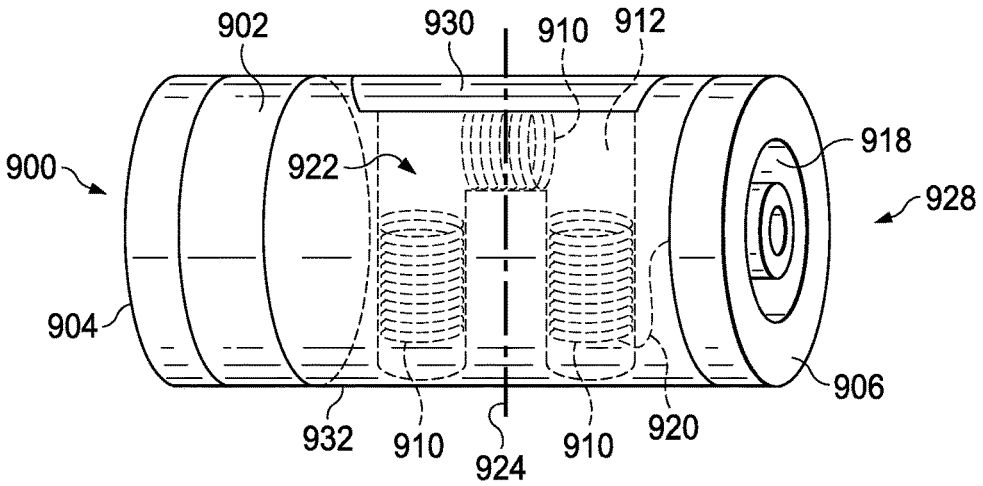
FIG. 9A illustrates a diagram of a detector in an instrumented cutting element utilizing a U-shaped core, in accordance with some embodiments of the present disclosure.

FIG. 9A illustrates a diagram of detector 900 in instrumented cutting element 928 utilizing U-shaped core 912, in accordance with some embodiments of the present disclosure. In the present embodiment, cutting table 904 (similar to cutting table 162 shown in FIG. 2A and/or cutting table 362 shown in FIG. 3) may be a PDC cutting table. Substrate 902 (similar to substrate 164 shown in FIG. 2A and/or substrate 364 shown in FIG. 3) may be composed of tungsten carbide with a cobalt binder and/or any other suitable material.

Substrate 902 may include detector housing 932 or detector housing 932 may be a continuation of substrate 902 or may be a separate material coupled to substrate 902 via welding, brazing, threaded connection, friction weld, and/or any other suitable means of connection. Detector housing 932 may include cavity 922. Detector housing 932 may have U-shaped core 912 and coil 910 inserted into it. Detector housing 932 may be made from the same material as substrate 902 or from a different material that may be simpler to machine, such as a non-magnetic material. Use of a non-magnetic material may improve the sensitivity of detector 900 to the presence of conductive and magnetizing materials, such as iron, transition metals, and/or transition metal alloys, particularly iron-based or cobalt-based alloys, because magnetic flux loss through cobalt may be essentially eliminated. Detector housing 932 may be brazed, welded, and/or attached in a suitable manner to substrate 902. Cavity 922 may be formed by being machined in detector housing 932, created with the use of an electro discharge machine (EDM) process, and/or manufactured with any other suitable method based in part on the conductivity, hardness and/or any other property of detector housing 932. Forming of cavity 922 may be based on the size, shape, or other characteristic of U-shaped core 912. Once all components of detector 900 are in place, cavity 922 may be filled with filler to essentially prevent the components of detector 900 from moving or becoming damaged. For example, cavity 922 may be filled with a suitable amount of a potting compound, such as a resin, a ceramic mixture that hardens, and/or any other suitable material.

Core 912 may be located within cavity 922 in detector housing 932. Core 912 may be composed of a material that may have a high permeability. For example, if detector 900 is to operate as an inductance sensor then core 912 may be composed of a ferrite, some other magnetically permeable material, and/or any other suitable material. In some embodiments, core 912 may be constructed of a non-magnetic, non-electrically conductive material based at least in part on the desired operating frequency of the detector. As another example, if detector 900 is to operate as a reluctance sensor then a portion of core 912 may be a samarium-cobalt ($SmCo_5$) magnet or an Alnico magnet (e.g., composed primarily of iron and aluminum (Al), nickel (Ni) and cobalt (Co)), or an electromagnetic, which may be used to energize the magnetic circuit. Other portions of core 912 may be composed of other transition metals and transition metal alloys, particularly iron-based or cobalt-based alloys. The end points of core 912 may be covered with erosion resistant caps (not expressly shown) that may be magnetically permeable. As another example, the end points of core 912 may be covered with erosion resistant material, such as PDC, tungsten carbide, or other suitable material containing a magnetizable binder, e.g., cobalt. In some embodiments, the erosion resistant caps may be non-magnetic. Core 912 may include more than one type of alloy to provide a distinctive magnetic flux density. Core 912 may be disposed in a U-shaped configuration to encourage magnetic flux leakage along sense axis 924. Use of core 912 in a U-shaped configuration may provide directional sensitivity when the two ends of core 912 are pointing approximately in the direction that instrumented cutting element 928 may make contact with an external magnetizable material, e.g., casing of an existing well.

Coil 910 may be located around all or portions of core 912. Coil 910 may be mounted on a bobbin (not expressly shown), for ease of manufacture, or wrapped directly onto core 912. Coil 910, while shown in three sections, may be one continuously wound coil around core 912. In some embodiments, multiple coils 910 may also be utilized. Coil 910 may be magnetic wire in that it is used for detecting magnetic flux changes in a winding. In some embodiments, coil 910 may be configured to maximize the number of turns on the bobbin (not expressly shown) and/or core 912 to optimize performance of detector 900. Coil 910 may include insulation and a conductor. For example, coil 910 may be varnish coated round copper wire. As another example, coil 910 may include square silver or copper drawn wire with a thin dielectric coating on it like PEEK (polyimide), Teflon, GORE insulated wires, a ceramic such as utilized in CERMAWIRE, and/or any other suitable wire and insulation. Selection of coil 610 material may be partially based on high temperatures associated with assembly of instrumented cutting element 628, e.g., brazing temperatures. For example, CERMAWIRE may suitably withstand brazing temperatures during assembly of instrumented cutting element 628. Utilizing a square conductor may reduce coil resistance per turn as compared with a round conductor based on increased area of the conductor, however, square conductors may be cost prohibitive. As yet another example, coil 910 may utilize a thermal insulator, such as a ceramic tube, to protect coil 910 and other components internal to detector 900 while brazing or other connection operation occurs to connect cutting table 904, substrate 902, and/or detector housing 932. In some embodiments, the insulating material may be in the shape of a hollow tube to allow the conductor to connect to connectors 918 on connector cap 906. Selection of material for coil 910 may depend on application specific factors such as temperature, vibration, and/or any other factors that may affect performance of coil 910. Further, although FIG. 9 illustrates coil 910 having only one layer of wire thickness, multiple layers of wire may be utilized to achieve the optimal operation of detector 900.

Connector cap 906 may be located proximate to and/or in contact with sensor housing 932. Connector cap 906 may utilize electrical connectors 918 to provide electrical connection and a signal or signals between coil wires 920 and corresponding connections in bit pocket 166 discussed with reference to FIG. 2A and/or bit pocket 366 discussed with reference to FIG. 3. Coil wires 920 may be communicatively coupled with electrical connectors 918 on connector cap 906. Electrical connector 918 may engage one or more mating connectors in the pocket for cutting element 928, e.g., bit pocket 166. Connector cap 906 may be welded, threaded, sealed, and/or connected in any other suitable manner to the end of substrate 902 located approximately opposite from cutting table 904.

Top cap 930 may be located proximate to and/or in contact with core 912. Top cap 930 may be composed of a non-magnetic material, such as, beryllium copper (BeCu) and/or a magnetic material. Top cap 930 may also include transition metals and transition metal alloys, particularly iron-based or cobalt-based alloys. Top cap 930 may be configured to provide axial support, e.g., support along sense axis 924, for core 912. Top cap 930 may be brazed or welded on to instrumented cutting element 928 once all components of detector 900 are in place. Final machining of detector 900 may be conducted to ensure that the outer diameter is approximately smooth to permit a strong brazing to the bit pocket.

In some embodiments, detector 900 may allow instrumented cutting element 928 to be mounted in an elongated pocket, such as an elongated bit pocket 166 shown on FIG. 2A and/or bit pocket 366 shown on FIG. 3. An elongated pocket may allow additional space for a larger U-shaped core 912 than may be allowed in a standard bit pocket.

Figure 9B:
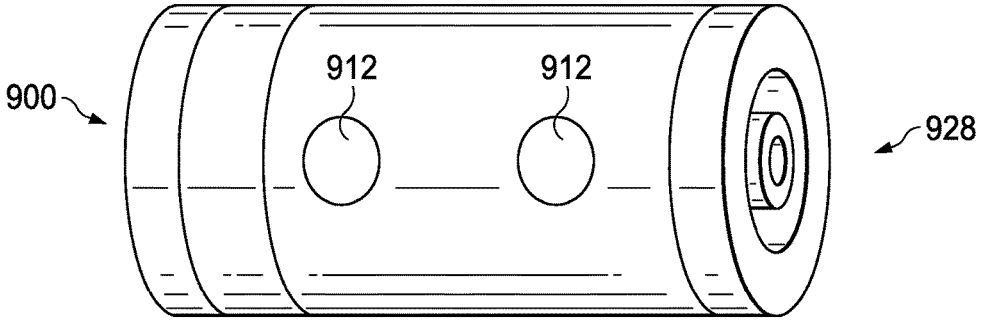
FIG. 9B illustrates a diagram of an exterior of an instrumented cutting element showing the location of a U-shaped core, in accordance with some embodiments of the present disclosure.

FIG. 9B illustrates a diagram of an exterior of instrumented cutting element 928 showing the location of U-shaped core 912, in accordance with some embodiments of the present disclosure. Ends of core 912 may be exposed to the outside of instrumented cutting element 928 to increase sensitivity over a configuration having detector housing 932 located between ends of core 912 and the outside of instrumented cutting element 928. However, a small amount of detector housing 932 material may be necessary to protect core 912. In some embodiments, a permeable wear resistant cap (not expressly shown) may also be employed. Further, while core 912 is shown in U-shape, other shapes are possible, such as a T-shaped, or a L-shaped core. In some embodiments, the shape of the cross-section of core 912 may be circular (as shown) while any cross-sectional geometric shape may be utilized for optimal performance of detector 900. For example, the cross-section of core 912 may be square shaped, oval shaped, or any other suitable shape. Further orientation of core 912 may be altered to focus the exiting magnetic field in any desired direction. For example, the end points of core 912 may be a half U-shape, e.g., an L-shape, where one end of core 912 extends downward and the other end remains coincident with the long axis of instrumented cutting element 928. In some embodiments, the diameter size of core 912 may vary from one end of core 912 to the other end of core 912 to aid in dispersion or concentration of the magnetic flux path.

Figure 9C:
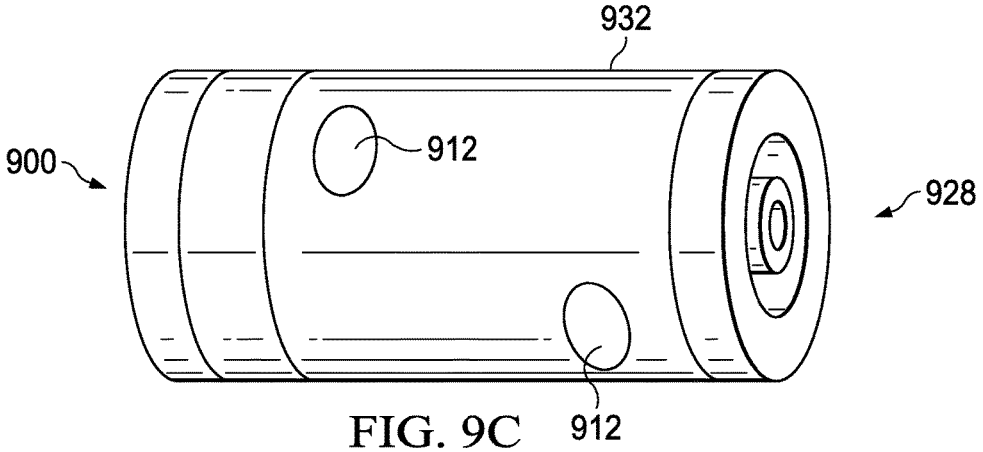
FIG. 9C illustrates a diagram of an instrumented cutting element utilizing an offset U-shaped core, in accordance with some embodiments of the present disclosure.

FIG. 9C illustrates a diagram of instrumented cutting element 928 utilizing an offset U-shaped core 912, in accordance with some embodiments of the present disclosure. Core 912 may be configured such that the two ends of core 912 are positioned at a radial angular difference from each other. Such a configuration may improve the amount of area in the wellbore, e.g., wellbore 114 shown with reference to FIG. 1, that may be monitored with each rotation of drill bit 101 and/or tool 320, e.g., the area sweep, over the configuration of core 912 shown in FIG. 9A, while reducing depth sensitivity. For example, core 912 may be configured such the two poles are approximately forty-five degrees offset from a parallel configuration. Further variations are possible and may include several radial poles at different angular positions around or partially around sensor housing 932. For example, radial poles of core 912 may be positioned similar to spokes on a wheel joined at the center by the center shaft core to complete the internal magnetic circuit. Hence, a plurality of core pole ends may be utilized to sense in multiple directions approximately simultaneously.

Figure 10A:
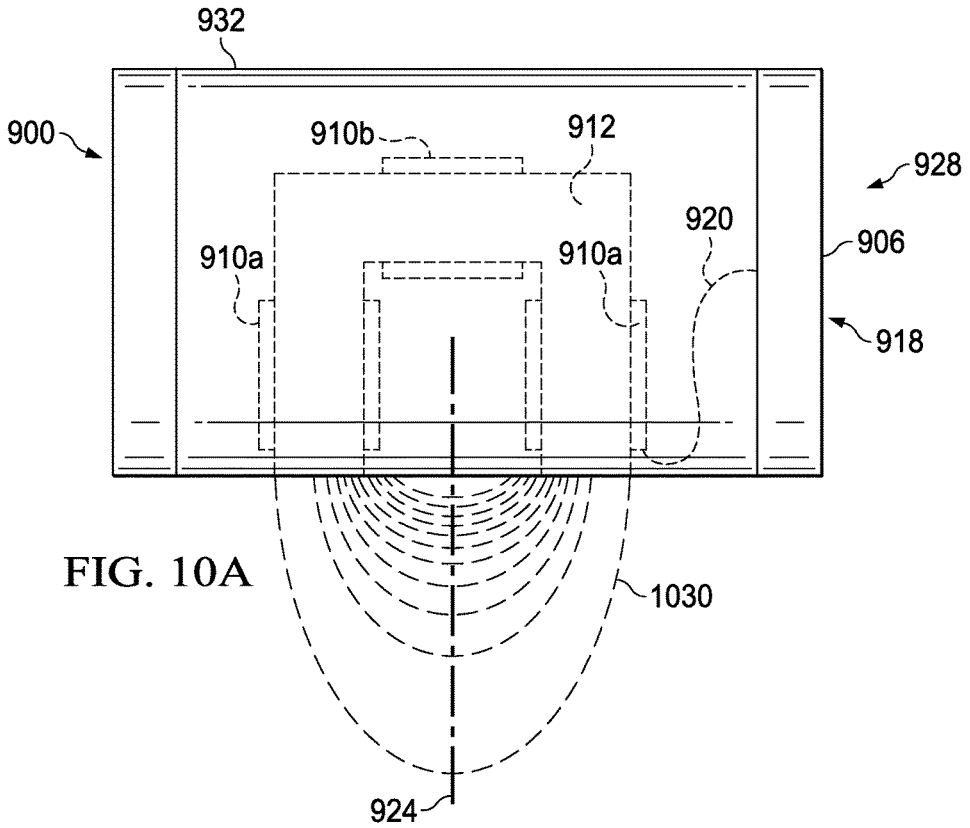
FIG. 10A illustrates an exemplary magnetic field that may occur during operation of the detector shown in FIG. 9A in the substantial absence of an existing well and/or other downhole obstruction, in accordance with some embodiments of the present disclosure.

FIG. 10A illustrates an exemplary magnetic field 1030 that may occur during operation of detector 900 shown in FIG. 9A in the substantial absence of an existing well and/or other downhole obstruction, in accordance with some embodiments of the present disclosure. When electrical current is applied to coil 910 (e.g., coils 910*a* and 910*b*) via coil wires 920 and electrical connectors 918 on connector cap 906, magnetic field 1030 may be generated. In some embodiments, coil 910*b*, surrounding the center of U-shaped core 912, may be utilized separately from coils 910*a*, which surround the ends of U-shaped core 912. In this case, coil 910*b* may be energized periodically to sense reluctance changes.

In some embodiments, all coils 910 may be coupled together to operate as an inductance sensor. When detector 900 operates as an inductance sensor, coil 910 via coil wires 920 and electrical connectors 918 in cap 906 may be energized by current and then de-energized, and magnetic field 1030 may be generated. The resultant current may be released and result in a ringing effect, e.g., ring-on frequency and amplitude. The ringing effect in cooperation with a capacitor, which may be located in detector 900 or bit body 124 shown in FIG. 2A and/or tubular body 324 shown in FIG. 3, may form an electrical tank circuit. The tank circuit voltage may experience an exponential decay, which may be described by the formula:

$$y(t)=A\cdot e^{-\lambda t}\cdot(\cos(\omega t+\phi)),\text{ where:}$$

y(t)=the output voltage of the tank circuit in Volts

A=the starting amplitude of the applied impulse voltage in Volts

ω=the rate of angular change of the ringing in radians/second

ϕ=the phase in radians. In this example, it will be set to zero.

λ=the decay constant t=time in seconds f=the frequency of the ringing which is ω÷2π. Adding the impulse time for repeated measurements, frequency f=1/(4*Δt).

Figure 10C:
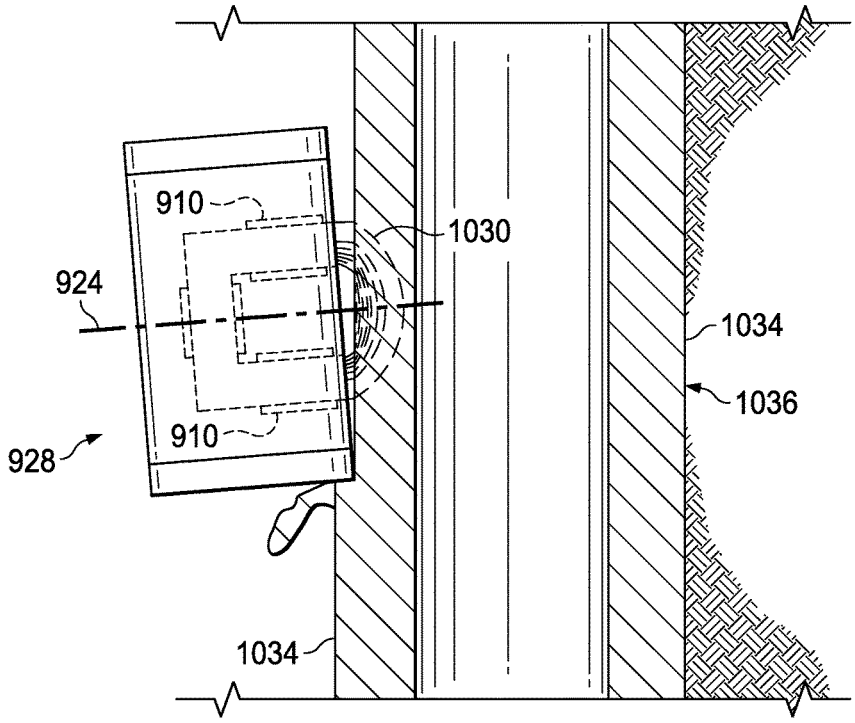
FIG. 10C illustrates an exemplary magnetic field for the detector shown in FIG. 9A in the situation where the drill bit may contact an existing well, in accordance with some embodiments of the present disclosure.
Figure 10B:
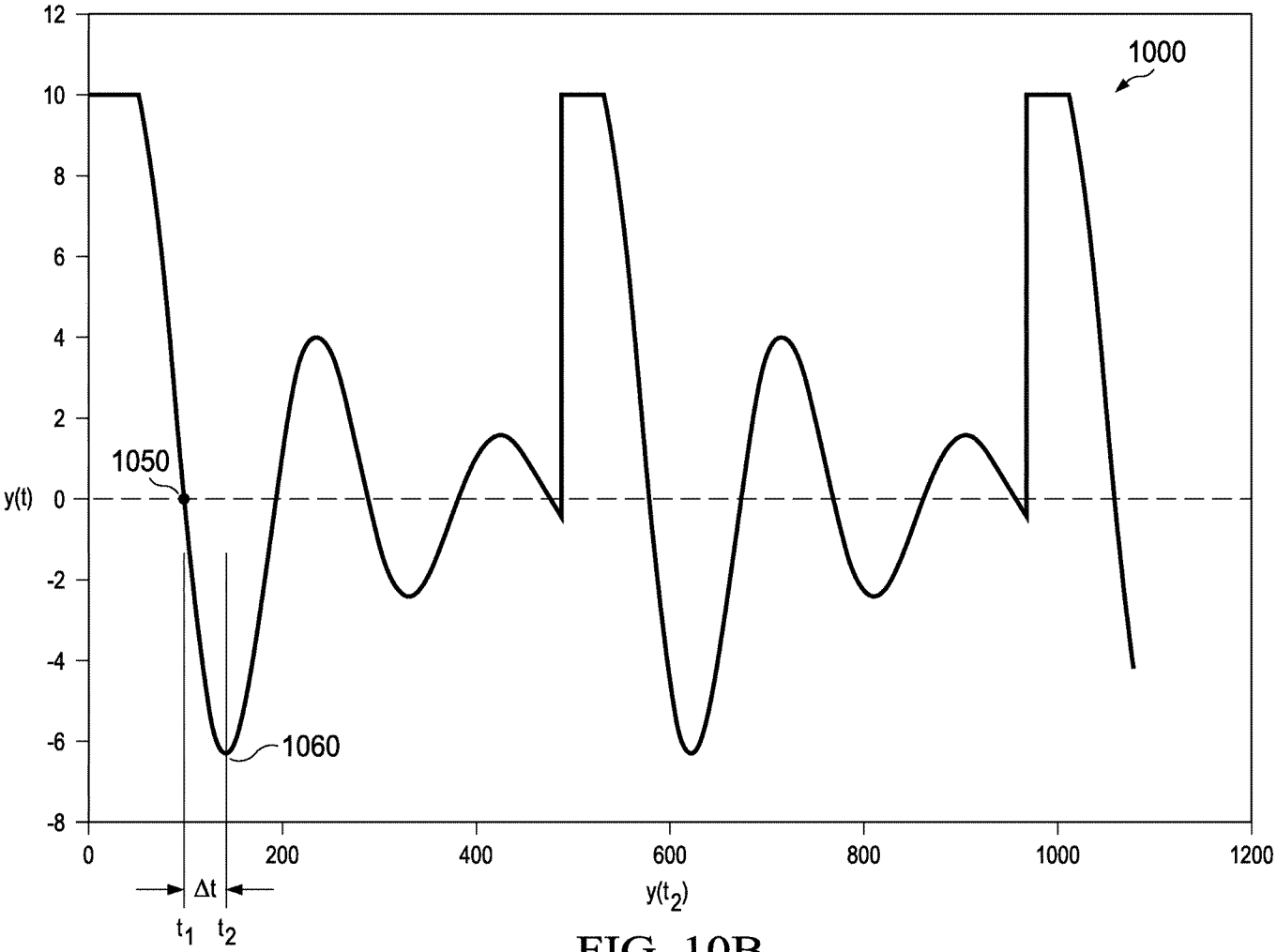
FIG. 10B illustrates an example plot of tank circuit voltage based on operation of the detector shown in FIG. 9A, in accordance with some embodiments of the present disclosure.

FIG. 10B illustrates an example plot 1000 of tank circuit voltage based on operation of detector 900 shown in FIG. 10A, in accordance with some embodiments of the present disclosure. For induction sensors, the frequency may change dependent upon the sensed conductivity of the material within the sense path of the magnetic flux circuit exiting and re-entering core 912. In some embodiments, the first zero crossing 1050 and the first negative peak 1060 may be utilized in determining the composition of material detector 900. As example, magnetizable material proximate to instrumented cutting element 928, such as a casing, may result in the frequency of the tank circuit decreasing and the first amplitude to the negative peak 1060 increasing. Response for detector 900 may be calibrated and stored in a measurement system. The measurements or representations of the measurements may further be recorded in downhole memory and may be transmitted to the surface. Downhole control system may also respond to measurements made by detector 900. For example, geo-steering may be aided through the automated control of a steerable assembly, such as a rotary steerable tool based on a model of the surrounding formation to seek a predetermined formation, e.g., an oil bearing sand above an aquifer. Further, in some embodiments, drill bit 101 and/or tool 320 may be automatically decoupled from the application of torque based on detecting magnetizable material.

Returning to FIG. 10A, in the substantial absence of external ferrous material, magnetic field 1030 may be generally elliptically shaped. However, magnetic field 1030 may interact with bit body 124, blades 126, and/or other components of drill bit 101 shown in FIG. 2A, and/or tubular body 324, blades, 326, and/or other components of tool 320 shown in FIG. 3, if any such components comprise magnetizable material. Such interaction may affect magnetic field 1030 and thus, may be accounted for in the operation of detector 900. Further, orienting the end points of core 912 such that the end points are not pointing toward the bit body but rather toward the cut direction of instrumented cutting element 828, may be optimal.

FIG. 10C illustrates an exemplary magnetic field 1030 for detector 900 shown in FIG. 9A in the situation where drill bit 101 and/or tool 320 may contact existing well 1036, in accordance with some embodiments of the present disclosure. As instrumented cutting element 929 contacts casing 1034 of existing well 1036, magnetic field 1030 may be altered. Alteration of magnetic field 1030 may occur in the presence of magnetizable or ferromagnetic material. Thus, both the shavings from casing 1034 and casing 1034, itself, may cause the change in magnetic field 1030. The alteration of magnetic field 1030 may change the reluctance of the magnetic circuit, which changes the magnetic flux density of coil 910 with each rotation of drill bit 101 and/or tool 320. The illustrated change in magnetic field 1030 is merely exemplary and more, less, and/or any other variation of change may occur that may be detected by detector 900.

In some embodiments, a change in magnetic flux density in instrumented cutting element 928 may cause current to flow in coil 910. The current may be detected by a detection circuit located in drill bit 101 and/or tool 320, e.g., in an electronics housing, and/or in BHA 120 shown in FIG. 1. The detection circuit may be coupled via an electrical pathway to electrical connectors 918 on connector cap 906 of instrumented cutting element 928. When the detection circuit detects the presence of the shavings and/or casing 1034, it may transmit the data to well site 106 via components of BHA 120 and/or any other downhole telemetry system. This transmission may alert users that drill bit 101 and/or tool 320 may be intersecting an obstruction that contains magnetizable material, e.g., existing well 1036. Alternately or in addition, a fail safe mechanism may be triggered that may, at least temporarily, decouple rotationally drill bit 101 and/or tool 320 from drill string 103 rotation substantially or completely stopping the rotation of drill bit 101 and/or tool 320 and thus, further cutting into casing 1034.

Operation of detector 900 in instrumented cutting element 928 may contribute to detection of the presence of a casing for an existing well, other magnetizable material, and/or current conducting objects at instrumented cutting element 928. Further, based on the direction that drill bit 101 and/or tool 320 is drilling into wellbore 114, sense axis 924 of detector 900 may be positioned in different directions, for example, to take advantage of the fact that wellbore 114 direction may be progressing approximately cross axis from the axis of instrumented cutting elements 928. In some embodiments, sense axis 924 of detector 900 may be configured in the direction of rotation of drill bit 101 and/or tool 320. As another example, sense axis 924 of detector 900 may be configured in the direction of the new hole being cut. Additionally, instrumented cutting element 928 may be an active or passive sensor. Instrumented cutting element 928 as a passive sensor may be utilized for detecting variable reluctance. Instrumented cutting element 928 as an active sensor may be utilized for detecting inductance and/or reluctance. An active sensor may constantly or periodically ping the inductor or the capacitor of a tank circuit. Further embodiments may include installing detectors 400, 600, 700 or 900 in a bit body, such as bit body 124, instead of installing in cutting elements 128.

Figure 11:
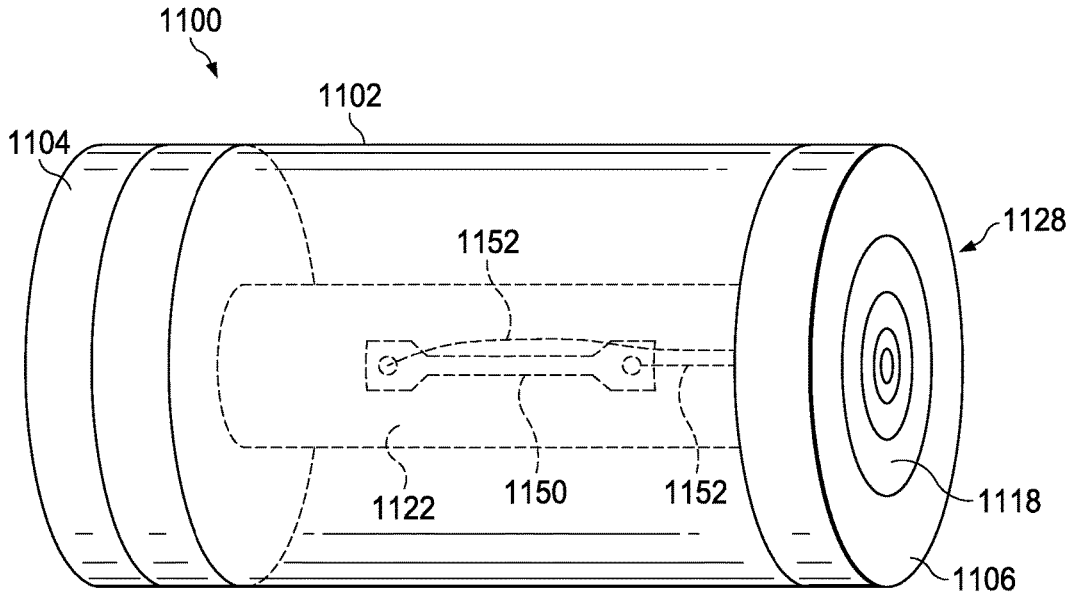
FIG. 11 illustrates a diagram of a detector in an instrumented cutting element with a strain gage, in accordance with some embodiments of the present disclosure.

FIG. 11 illustrates a diagram of detector 1100 in instrumented cutting element 1128 with strain gage 1150, in accordance with some embodiments of the present disclosure. Although not expressly shown, detector 1100 may include any of the components discussed with respect to detector 400, 600, or 700 shown in FIGS. 4, 6, and 7A-7C, respectively. Additionally, detector 1100 may include sensors, such as strain gage 1150. Strain gage 1150 may be positioned in substrate 1102, on the inner wall of cavity 1122, and/or any other suitable location. Strain gage 1150 may be configured to measure deformation of detector 1100 due to loads placed on cutting table 1104 and/or substrate 1102. Although FIG. 11 illustrates only one strain gage 1150, multiple strain gages 1150 may be utilized. Strain gage 1150 may be coupled by gage wires 1152 to connector 1118 in connector cap 1106.

In some embodiments, strain gage 1150 may be configured to sense the torque applied to the tip of cutting table 1104. When cutting table 1104 contacts a formation, strain gage 1150 may measure the strain or bending that detector 1100 experiences. Strain gage 1150 may be aligned with the cutting edge of cutting table 1104. Additionally, a position indicator may be present on the exterior of instrumented cutting element 1128 to designate the direction of installation to achieve optimum operation of strain gage 1150. Further, following installation of strain gages 1150 and any other components internal to detector 1100, cavity 1122 may be substantially evacuated of air and moisture and filled with a potting compound, dry inert air (e.g., Nitrogen molecules, $N_2$), and/or a non-reactive and compatible fluid such as oil.

Figure 12:
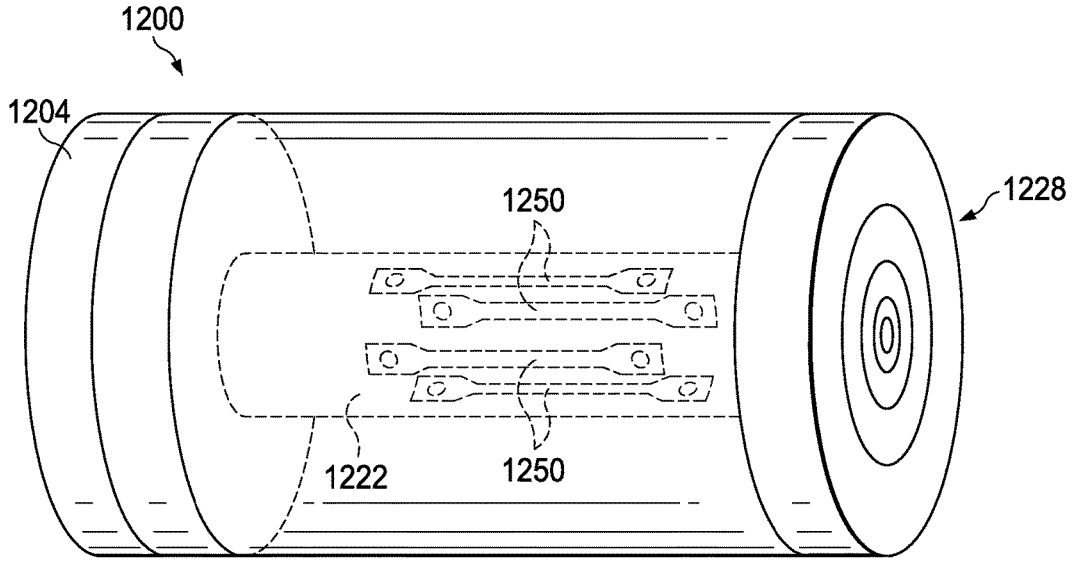
FIG. 12 illustrates a diagram of a detector in an instrumented cutting element with multiple strain gages, in accordance with some embodiments of the present disclosure.

FIG. 12 illustrates a diagram of detector 1200 in instrumented cutting element 1228 with multiple strain gages 1250, in accordance with some embodiments of the present disclosure. Although not expressly shown, detector 1200 may include any of the components discussed with respect to detector 400, 600, or 700 shown in FIGS. 4, 6, and 7A-7C, respectively. Detector 1200 may include multiple strain gages 1250. Multiple strain gages 1250 may be utilized to provide measurement accuracy over the configuration of detector 1100 shown in FIG. 11. Strain gages 1250 may be mounted in a "wheatstone bridge" configuration in which strain gages 1250 are mounted approximately ninety degrees from each other around the inner wall of cavity 1222. Other configurations of strain gages 1250 may be employed. For example, strain gages 1250 may be positioned near cutting table 1204 to provide detection of weight and/or any other suitable characteristics. Further, following installation of strain gages 1250 and any other components internal to detector 1200, cavity 1222 may be substantially evacuated of air and moisture and filled with a potting compound, dry inert air (e.g., Nitrogen molecules, $N_2$), and/or a non-reactive and compatible fluid such as oil.

In some embodiments, additional strain gages (not expressly shown) may be configured perpendicular to the axial direction of detector 1200. In such a configuration, the strain gages may be utilized to determine the axial force applied to instrumented cutting element 1228.

Further, one or more of strain gages 1250 may include or be proximate to a temperature sensor (not expressly shown), e.g., a thermocouple capable of withstanding the brazing temperatures. For example, the temperature sensor may also be mounted to the inner wall of cavity 1222. The temperature sensor may be used to adjust detector 1200 measurements based on measurement drift due to temperature during operation and/or based on a previous calibration. Further the temperature sensor may monitor instrumented cutting element 1228. For example, if the temperature sensor detects that instrumented cutting element 1228 is hotter than optimal, the elevated temperature may indicate a plugged jet near instrumented cutting element 1228 and/or an issue relating to fluid circulation proximate to instrumented cutting element 1228.

Figure 13:
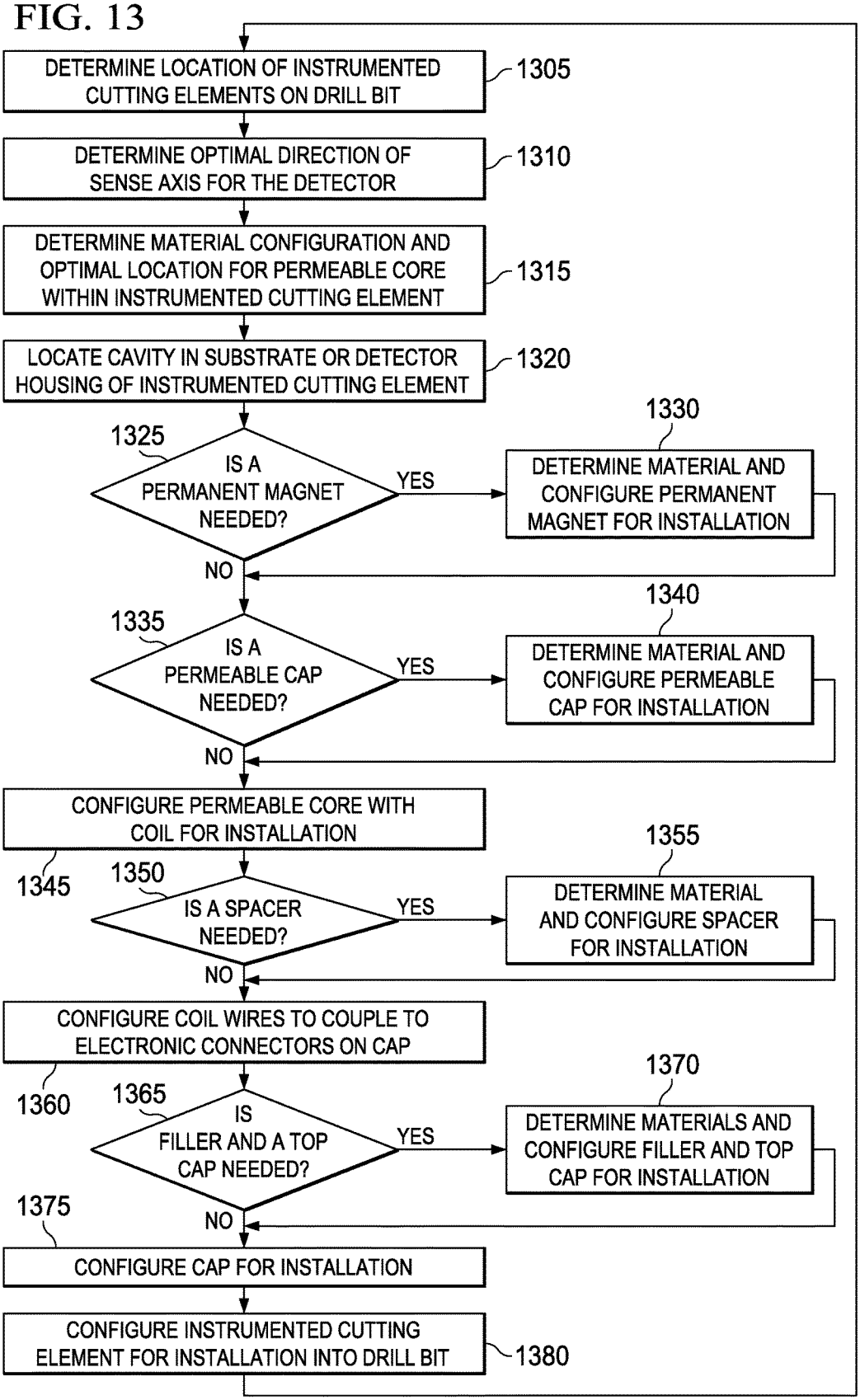
FIG. 13 illustrates a flow chart of an example method of determining and generating the instrumented cutting elements of FIG. 4, 6, 7A-7C or 9A, in accordance with some embodiments of the present disclosure.

FIG. 13 illustrates a flow chart of an example method 1300 of determining and generating instrumented cutting elements 428, 628, 728, or 928 of FIG. 4, 6, 7A-7C or 9A, respectively, in accordance with some embodiments of the present disclosure. In the illustrated embodiment, the cutting structures of the bit, including at least the locations and orientations of all cutting elements, may have been previously designed. However in other embodiments, method 1300 may include steps for designing an instrumented cutting element of a drill bit. For illustrative purposes, method 1300 is described with respect to instrumented cutting element 428 of FIG. 4 and instrumented cutting element 928 of FIG. 9A; however, method 1300 may be used to determine and generate an instrumented cutting element for any suitable drill bit.

The steps of method 1300 may be performed by various computer programs, models or any combination thereof, configured to simulate and design drilling systems, apparatuses and devices. The programs and models may include instructions stored on a computer readable medium and operable to perform, when executed, one or more of the steps described below. The computer readable media may include any system, apparatus or device configured to store and retrieve programs or instructions such as a hard disk drive, a compact disc, flash memory or any other suitable device. The programs and models may be configured to direct a processor or other suitable unit to retrieve and execute the instructions from the computer readable media. Collectively, the computer programs and models used to simulate and design drilling systems may be referred to as a "drilling engineering tool" or "engineering tool."

Method 1300 may start, and at step 1305, the engineering tool may determine the location of an instrumented cutting element on a drill bit, such as drill bit 101 of FIG. 2A and/or tool 320 of FIG. 3. For example, based on characteristics of the well to be drilled, e.g., direction, the engineering tool may determine that an instrumented cutting element may be located close to the downward end of the drill bit to have an optimal opportunity to detect an existing well and/or other structure before the drill bit substantially contacts or drills into the existing well and/or other structure. For example the engineering tool may determine that multiple instrumented cutting elements 428 may be optimally located in shoulder zones 308*a* and 308*b* and/or in nose zones 310*a* and 310*b* shown on FIG. 2B.

At step 1310, the engineering tool may determine the optimal direction of the sense axis for the detector in the instrumented cutting element. For example, the engineering tool may determine the direction of sense axis 424 of detector 400 shown in FIG. 4. In one embodiment, the direction of sense axis 424 may be based on the direction drill bit 101 and/or tool 320 may be drilling and the location of instrumented cutting elements 428 on drill bit 101 and/or tool 320. Each detector 400 may be configured to have the direction of sense axis 424 essentially the same. In some embodiments, some set of detectors 400 may be configured to have the direction of sense axis 424 point in different directions to increase the area sweep of detectors 400. In some embodiments, the detector may be designed to sense characteristics of the formation. The detector may be oriented in alignment with the apex of the groove or kerf being cut by the cutting table, such as cutting table 404, into the formation. Optionally, the detector may be designed to measure magnetizable material mixed with fluid or mud and may be oriented with the sense axis toward the junk slot areas of the drill bit. As another example, the detector may be designed to measure mud properties and may be oriented to sense the fluid exiting the nozzles of the drill bit or be positioned inside of the drill bit fluid flow path. Different orientations and types of detectors may be used simultaneously to make combined and/or extracted measurements. An extracted measurement may include compensating the measured values for various sources of noise. Further, detectors may be aggregated through azimuthal orientation with the aid of angular position detection to determine a azimuthal profile of the wellbore based on the detector response. Hence, the coordinate placement of the detectors on the drill bit relative to a reference position on the drill bit may be utilized to map out the surrounding conductive and/or reluctance profile of the wellbore bottom and sidewalls.

At step 1315, the engineering tool may determine the optimal material, location and/or configuration for the core within the instrumented cutting element. For example, the core may be cylindrically shaped, such as core 412, and may be placed in the center of substrate 402. As another example, a cylindrical core 412 may be placed off-center in substrate 402, shown by cutting face 804*b* in FIG. 8. As still another example, the core may be U-shaped, similar to core 912 shown in FIG. 9A. The shape of the core may be based on models to ensure mechanical integrity of the sensor, wear life, depth of sense, and/or other suitable factors. For example, if a shallow, broad area is to be sensed, then the exit point of the magnetic circuit may be broadened by use of a larger or U-shaped core, such as core 912. If a narrower, deeper penetrating focused area is to be sensed, then the core may be smaller, e.g., core 412 may be utilized. Core material may be based on the optimal magnetic permeability for the particular application as discussed with reference to FIGS. 4 and 6. For example, the core may be a ferrite or related material.

At step 1320, the engineering tool may locate the cavity in the substrate or the detector housing of the instrumented cutting element. For example, cavity 422 may be located in substrate 402 based on the shape of core 412 and the optimal location determined at step 1315 as shown in FIG. 4. As another example, cavity 922 may be shaped in detector housing 932 as shown in FIG. 9A.

As step 1325, the engineering tool may determine if a permanent magnet is needed. Use of a magnetic source may depend on the designed use of the detector. For example, if the detector may function primarily as a reluctance sensor, then a magnetic source may be utilized. Magnetic source, e.g., permanent magnet 408 may be utilized as shown in FIG. 4. The magnetic source may be of any shape, however, the orientation of the permanent magnet dipole magnetic moment may be coaxial with the core to encourage magnetic flux admittance into the magnetic circuit. As another example, if the detector may function as an inductance sensor, a permanent magnet may not be utilized. Detector 600 shown in FIG. 6 illustrates a detector configured to be utilized as an inductance sensor. If a permanent magnet is to be utilized, method 1300 may proceed to step 1330. If a permanent magnet will not be utilized, method 1300 may proceed to step 1335.

As step 1330, the engineering tool may determine the appropriate material and configuration for the permanent magnet. For example, the configuration and materials discussed with reference to FIG. 4 for permanent magnet 408 may be employed.

At step 1335, the engineering tool may determine if a core cap is needed. This determination may be based on the measurement sensitivity needed, the number of instrumented cutting elements to be used, the likelihood of contacting a downhole obstruction, and/or any other suitable criteria. For example, a core cap may be utilized if the core material selected is not durable enough to withstand drilling abrasion. As another example, a core cap may have minimum magnetic permeability if abrasion resistance properties are better achieved with alternative non-magnetizable material. Further, a core cap may either be non-magnetizable or may not be necessary if the magnetic circuit created by the detector is sufficient. If the detector may function as a reluctance sensor, then core cap may not be utilized. However, if the detector may function as an inductance sensor, a core cap may be utilized. For example, if it is determined that the magnetic field created by detector 400 is not sufficient, core cap 748, shown in FIGS. 7A-7C, may be utilized. If a core cap is determined to be needed, method 1300 may proceed to step 1340. If a core cap is not needed, method 1300 may proceed to step 1345.

As step 1340, the engineering tool may determine the appropriate material and configuration for the core cap. For example, any of the configurations and materials discussed with reference to FIGS. 7A-7C for core cap 748 may be employed.

At step 1345, the engineering tool may configure the core with the coil for installation. For example, with reference to FIG. 9A, the engineering tool may determine if coil 910 may be one continuous coil or separate coils and may configure U-shape core to be installed in detector housing 932. The size of the coil is determined by calculations, modeling, testing, and/or any other suitable method. A detector that may function as a reluctance sensor may employ a coil that maximizes the detector's sensitivity to magnetic flux changes passing through its cross-section. A detector that may function as an induction sensor may employ a coil tuned such that the frequency and dampening response is in an optimal range to sense the conductivity of the surrounding environment.

Hence, the characteristics of the coil to be utilized may depend on a number of factors, such as the available space for the core and the winding, the magnetic permeability of the core, the number of turns required for the coil, the resistance of the wire length on the core, and/or other suitable factors. The engineering tool may model multiple configurations of the core and coil to optimize these factors.

As step 1350, the engineering tool may determine if a spacer is needed. A spacer, such as spacer 414 shown in FIG. 4, may be used when a cylindrical shaped core 412 is utilized. However, a spacer may not be necessary when a U-shaped core 912 is utilized as shown in FIG. 9A. If a spacer is determined to be needed, method 1300 may proceed to step 1355. If a spacer is not needed, method 1300 may proceed to step 1360.

As step 1355, the engineering tool may determine the appropriate material and configuration for the spacer. For example, spacer 414 shown in FIG. 4 may be employed, which may be composed of a material that may not interfere with the magnetic field created by detector 400. For example, spacer 414 may be composed of a non-magnetic material, such as, beryllium copper (BeCu), and/or any other suitable material including a magnetically permeable material based on the desired sense characteristics of the detector.

At step 1360, the engineering tool may configure the coil wires to couple with the electronic connectors on the cap. For example, with reference to FIG. 9A, the engineering tool may configure coil wires 920 to couple with electronic connectors 918 on connector cap 906. As another example, with reference to FIG. 4, the engineering tool may configure coil wires 420 to couple with electronic connectors 418 on connector cap 406. Connector cap 406 may utilize electrical connectors 418 to provide electrical connection between coil wires 420 and corresponding connections in bit pocket 166 discussed with reference to FIG. 2A and/or bit pocket 366 discussed with reference to FIG. 3. Coil wires 420 may be communicatively coupled with electrical connectors 418 on connector cap 406.

At step 1365, the engineering tool may determine if a filler and top cap is needed. A top cap, such as top cap 930 shown in FIG. 9A, with a filler may be used when a U-shaped core 912 is utilized. However, a top cap and filler may not be necessary when a cylindrical core 412 is utilized as shown in FIG. 4. If filler and top cap are utilized, method 1300 may proceed to step 1370. If filler and top cap are not utilized, method 1300 may proceed to step 1375.

As step 1370, the engineering tool may determine the appropriate materials and configuration for the filler and top cap. For example, top cap 930 shown in FIG. 9A and a filler material, such as a ceramic, may be employed. Cavity 922 may be filled with filler to essentially prevent the components of detector 900 from moving or becoming damaged. For example, cavity 922 may be filled with a suitable amount of a potting compound, such as a resin, a ceramic mixture that hardens, and/or any other suitable material. Top cap 930 may be placed after the filler is inserted into cavity 922. Top cap 930 may be composed of a non-magnetic material, such as, beryllium copper (BeCu) and/or a magnetic material. Top cap 930 may also include transition metals and transition metal alloys. Top cap 930 may be configured to provide axial support, e.g., support along sense axis 924, for core 912. Top cap 930 may be brazed or welded on to instrumented cutting element 928 once all components of detector 900 are in place.

As step 1375, the engineering tool may configure the connector cap for installation. For example, connector cap 406 and electrical connectors 418 shown in FIG. 4 may be installed on instrumented cutting element 428. As another example, connector cap 906 and electrical connectors 918 shown in FIG. 9A may be configured to be installed on instrumented cutting element 928.

At step 1380, the engineering tool may configure the instrumented cutting element for installation into the drill bit. For example, instrumented cutting element 428 shown in FIG. 4 may be installed in drill bit 101 shown in FIG. 2A and/or tool 320 shown in FIG. 3. As another example, instrumented cutting element 928 shown in FIG. 9A may be installed in drill bit 101 shown in FIG. 2A and/or tool 320 shown in FIG. 3.

Although the present disclosure and its advantages have been described in detail, it should be understood that various changes, substitutions and alterations can be made herein without departing from the spirit and scope of the disclosure as defined by the following claims.

What is claimed is:

1. A drilling system, comprising:
- a drill string; and
- a drill tool coupled to the drill string, the drill tool comprising:
  - a cylindrical body;
  - a plurality of blades on exterior portions of the cylindrical body; and
- an instrumented cutting element on one of the plurality of blades, the instrumented cutting element comprising:
  - a cutting table;
  - a substrate coupled to the cutting table, the substrate including a cavity;
  - a core in the cavity;
  - an electrical connector coupled to the substrate; and
  - a coil wire coupled to the electrical connector and surrounding portions of the core, the coil wire configured to generate a signal in response to the instrumented cutting element being proximate to a magnetizable material.

2. The drilling system of claim 1, further comprising:
- an internal controller communicatively coupled to the drill string; and
- a detection circuit communicatively coupled to the instrumented cutting element and configured to detect the signal and provide a command to the internal controller.

3. The drilling system of claim 2, wherein the command causes at least one of ceasing rotation of the drill tool, decoupling the drill tool from the drill string, and a change in a drilling direction of the drill tool.

4. The drilling system of claim 1, wherein the signal is responsive to at least one of conductivity of the magnetizable material, magnetic permeance of the magnetizable material, and a change in a magnetic field.

5. The drilling system of claim 1, wherein the magnetizable material comprises a manmade material.

6. The drilling tool of claim 1, wherein the instrumented cutting element further comprises a permanent magnet coupled to the cutting table and the core.

7. The drilling system of claim 6, wherein the permanent magnet defines a sense axis extending through the cutting table.

8. The drilling system of claim 1, wherein the core is configured in a U-shape and defines a sense axis extending perpendicular to the cutting table of the instrumented cutting element.

9. The drilling system of claim 1, wherein the core comprises a magnetically permeable material.

10. A method for drilling a wellbore, comprising:

configuring an instrumented cutting element in a drill tool, the drill tool comprising a cylindrical body, a plurality of blades on exterior portions of the cylindrical body, the instrumented cutting element being on one of the plurality of blades, the instrumented cutting element comprising:

a cutting table;

a substrate coupled to the cutting table, the substrate including a cavity;

a core in the cavity;

an electrical connector coupled to the substrate; and a coil wire coupled to the electrical connector and surrounding portions of the core;

generating, by the instrumented cutting element, the signal in response to the instrumented cutting element being proximate to a magnetizable material; and detecting the signal by a detection circuit and providing a command to an internal controller.

11. The drilling system of claim 10, wherein the command causes at least one of ceasing rotation of the drill tool, decoupling the drill tool from the drill string, and a change in a drilling direction of the drill tool.

12. The method of claim 10, wherein the signal is responsive to at least one of conductivity of the magnetizable material, magnetic permeance of the magnetizable material, and a change in a magnetic field.

13. The method of claim 10, wherein the magnetizable material comprises a manmade material.

14. An instrumented cutting element, comprising:

a cutting table;

a substrate coupled to the cutting table, the substrate including a cavity;

a core in the cavity;

an electrical connector coupled to the substrate; and a coil wire coupled to the electrical connector and surrounding portions of the core, the coil wire configured to generate a signal in response to the instrumented cutting element being proximate to a magnetizable material.

15. The instrumented cutting element of claim 14, further comprising a permanent magnet coupled to the cutting table and the core.

16. The instrumented cutting element of claim 15, wherein the permanent magnet defines a sense axis extending through the cutting table.

17. The instrumented cutting element of claim 14, wherein the core is configured in a U-shape and defines a sense axis extending perpendicular to the cutting table of the instrumented cutting element.

18. The instrumented cutting element of claim 14, wherein the core comprises a magnetically permeable material.

19. A method of configuring an instrumented cutting element of a drill tool, comprising:

determining a location of the instrumented cutting element on the drill tool, the drill tool comprising a cylindrical body, a plurality of blades on exterior portions of the cylindrical body, the instrumented cutting element being on one of the plurality of blades;

determining a direction for a sense axis of the instrumented cutting element;

configuring a core in the instrumented cutting element based on the sense axis and location of the instrumented cutting element, the core located in a cavity in a substrate, and a cutting table coupled to the substrate;

configuring an electrical connector coupled to the substrate; and configuring a coil wire coupled to the electrical connector and surrounding portions of the core, the coil wire configured to generate a signal in response to the instrumented cutting element being proximate to a magnetizable material.

20. The method of claim 19, further comprising configuring a permanent magnet for placement in the instrumented cutting element based on the sense axis extending through a cutting table.

21. The method of claim 19, wherein configuring the core further comprises configuring the core in a U-shape if the direction determined for the sense axis is extending perpendicular to a cutting table of the instrumented cutting element.

22. The method of claim 19, wherein the core comprises a magnetically permeable material.

* * * * *